US009259919B2

(12) United States Patent
Otsuka et al.

(10) Patent No.: US 9,259,919 B2
(45) Date of Patent: Feb. 16, 2016

(54) LIQUID DISCHARGE APPARATUS AND CONTROL METHOD OF LIQUID DISCHARGE APPARATUS

(71) Applicant: Seiko Epson Corporation, Tokyo (JP)

(72) Inventors: Shuji Otsuka, Shiojiri (JP); Tadashi Kiyuna, Hachioji (JP); Toshifumi Asanuma, Hamura (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 14/699,326

(22) Filed: Apr. 29, 2015

(65) Prior Publication Data

US 2015/0314596 A1 Nov. 5, 2015

(30) Foreign Application Priority Data

May 2, 2014 (JP) ..... 2014-095279

(51) Int. Cl.
*B41J 2/04* (2006.01)
*B41J 2/045* (2006.01)

(52) U.S. Cl.
CPC ..... *B41J 2/04548* (2013.01); *B41J 2/04* (2013.01); *B41J 2/04541* (2013.01)

(58) Field of Classification Search
CPC ..... B41J 2/06; B41J 2/1433; B41J 2/17526; B41J 2/04541; B41J 2002/14459; B41J 2002/14491
See application file for complete search history.

(56) References Cited

U.S. PATENT DOCUMENTS 7,276,958 B2 * 10/2007 Miyamitsu ..... G05F 3/222 327/112
7,852,128 B2 * 12/2010 Kitazawa ..... B41J 2/04541 327/111
2009/0206888 A1 8/2009 Kitazawa et al.

FOREIGN PATENT DOCUMENTS

JP 2004-153411 A 5/2004
JP 2009-190287 A 8/2009
JP 2010-114711 A 5/2010

* cited by examiner

*Primary Examiner* — Lamson Nguyen
(74) *Attorney, Agent, or Firm* — Harness, Dickey & Pierce, P.L.C.

(57) ABSTRACT

A liquid discharge apparatus includes a piezoelectric element in which a drive signal is applied and which is displaced to eject a liquid; a zeroth wire of a zeroth potential; a first wire of a first potential that is higher than the zeroth potential; a second wire of a second potential that is higher than the first potential; and a connection path selecting section that electrically connects one end of the piezoelectric element to the zeroth wire, the first wire, or the second wire in response to a voltage of a source drive signal that controls the voltage of the drive signal and a hold voltage of the piezoelectric element. Here, a first potential difference from the zeroth potential to the first potential is different from a second potential difference from the first potential to the second potential.

6 Claims, 17 Drawing Sheets

<STATUS A (SELECTION OF TERMINAL a)>

<STATUS B (SELECTION OF TERMINAL b)>

<COMPARATIVE EXAMPLE 1>

<COMPARATIVE EXAMPLE 2>

〈VOLTAGE-CAPACITANCE CHARACTERISTICS OF PIEZOELECTRIC ELEMENT〉

〈EMBODIMENT〉

LIQUID DISCHARGE APPARATUS AND CONTROL METHOD OF LIQUID DISCHARGE APPARATUS

The entire disclosure of Japanese Patent Application No. 2014-095279, filed May 2, 2014 is expressly incorporated by reference herein.

BACKGROUND

1. Technical Field

The present invention relates to a liquid discharge apparatus and a control method of the liquid discharge apparatus.

2. Related Art

As an ink jet printer that discharges ink and prints an image or a document, a printer that uses piezoelectric elements (for example, piezo elements) is known. The piezoelectric elements are provided corresponding to a plurality of nozzles in a head unit (print head), respectively, and are driven in accordance with drive signals, respectively, and thereby a predetermined amount of ink (liquid) is discharged from the nozzle at a predetermined timing. The piezoelectric element is a capacitive load like a capacitor in terms of electric power. Therefore, a sufficient current needs to be supplied so as to operate the piezoelectric element of each nozzle.

Therefore, in the related art, a configuration is known, in which a source drive signal of the drive signal to be generated is amplified by using an amplifier circuit and the amplified drive signal is supplied to the head unit such that the piezoelectric element is driven. Examples of the amplifier circuit include a system of performing current amplification of the source drive signal by using a class AB amplifier or the like (linear amplification system, see JP-A-2009-190287) or a system of demodulating by using a low pass filter after pulse width modulation, pulse density modulation, or the like of the source drive signal (class D amplification system, see JP-A-2010-114711). In addition, a system of switching a voltage that is applied to a piezoelectric element into a plurality of levels (voltage switching system, see JP-A-2004-153411) is also proposed, in addition to a configuration in which the source drive signal is amplified by using the amplifier circuit.

However, the linear amplification system results in high power consumption and poor energy efficiency. The class D amplification system achieves higher energy efficiency, compared to the linear amplification system, but has a problem of an occurrence of electromagnetic interference (EMI) because high currents are switched at a high frequency. In addition, in the voltage switching system described above, power saving is achieved to some extent, but still has to be improved.

SUMMARY

An advantage of some aspects of the invention is to provide a liquid discharge apparatus and a control method of the liquid discharge apparatus, in which energy efficiency is high, an occurrence of EMI is suppressed, and power consumption is reduced.

A liquid discharge apparatus according to an aspect of the invention includes: a piezoelectric element in which a drive signal is applied to one end thereof and which is displaced in response to voltages of the one end and the other end thereof; a cavity which is filled with a liquid and of which an inside volume is expanded and contracted due to the displacement of the piezoelectric element; a nozzle that communicates with the cavity and is capable of discharging the liquid by the expansion and contraction of the inside volume of the cavity; a zeroth wire of a zeroth potential; a first wire of a first potential that is higher than the zeroth potential; a second wire of a second potential that is higher than the first potential; and a connection path selecting section that electrically connects one end of the piezoelectric element to the zeroth wire, the first wire, or the second wire in response to a voltage of a source drive signal that controls the voltage of the drive signal and a hold voltage of the piezoelectric element. Here, a first potential difference from the zeroth potential to the first potential is different from a second potential difference from the first potential to the second potential.

In this configuration, charging and discharging of the piezoelectric element are executed while a potential of the piezoelectric element switches between a range (voltage step) from the zeroth potential to the first potential and a range from the first potential to the second potential. In the charging and the discharging, since the switching proceeds in a stepwise manner, it is possible to improve energy efficiency, compared to a configuration in the related art in which the switching is performed at a time. In addition, since the switching is not performed on a high current like a current of the class D amplification, it is possible to prevent an occurrence of EMI.

In addition, although the piezoelectric element is a capacitive load like a capacitor in terms of electric power as described above, the capacitance has voltage dependence to be changed by an applied voltage. In this case, in the piezoelectric element, the capacitance is decreased in a region in which a high voltage is applied; and the capacitance is increased in a region in which a low voltage is applied. Therefore, even when the change of the applied voltage in the piezoelectric element is the same, power consumption becomes lower in the region in which the high voltage is applied than in the region in which the low voltage is applied. When a voltage step in a voltage region in which the capacitance is decreased is wider than a voltage step in a voltage region in which the capacitance is increased, it is possible to reduce the power consumption.

In the liquid discharge apparatus according to the aspect, the second potential difference may be higher than the first potential difference. In a common piezo element as the piezoelectric element, the higher the applied voltage, the more the capacitance is decreased. Therefore, when a voltage step in a high voltage region in which the capacitance is decreased is wider than a voltage step in a low voltage region in which the capacitance is increased, it is possible to reduce the power consumption.

In the liquid discharge apparatus according to the aspect, the second potential difference may be greater than the first potential difference in a case where a time for which the potential of the drive signal is maintained in a first range from the zeroth potential or higher to lower than the first potential is longer than a time for which the potential of the drive signal is maintained in a second range from the first potential or higher to lower than the second potential. The second potential difference may be lower than the first potential difference in a case where the time for which the potential of the drive signal is maintained in the first range is shorter than the time for which the potential of the drive signal is maintained in the second range.

According to the configuration, the time for which the potential of the drive signal is maintained in a first range is longer than the time for which the potential of the drive signal is maintained in a second range, which means that an average potential (voltage) of the drive signal becomes lower. On the contrary, the time for which the potential of the drive signal is maintained in the first range is shorter than the time for which the potential of the drive signal is maintained in the second range which means that the average potential (voltage) of the drive signal becomes higher. Accordingly, as in the configuration described above, when the voltage step obtained by the longer maintained time becomes wider, it is possible to reduce the power consumption.

In addition, the liquid discharge apparatus according to the aspect may further include: a p-th wire of a p-th potential; a (p+1)-th wire of a (p+1)-th potential which is higher than the p-th potential; a q-th wire of a q-th potential; and a (q+1)-th wire of a (q+1)-th potential which is higher than the q-th potential. The connection path selecting section may electrically connect one end of the piezoelectric element to the p-th wire, the (p+1)-th wire, the q-th wire, or the (q+1)-th wire in response to a voltage of a source drive signal that controls the voltage of the drive signal and a hold voltage of the piezoelectric element. When a predetermined standby non-discharge potential is between the n-th potential or higher and lower than the (n+1)-th potential, the p-th potential difference from the p-th potential to the (p+1)-th potential is lower than the q-th potential difference from the q-th potential to the (q+1)-th potential. When the standby non-discharge potential is between the n-th potential or higher and lower than the (n+1)-th potential, it is assumed that the voltage change of the drive signal highly frequently occurs in the range of the potential. Accordingly, as in the configuration described above, when the voltage step in which the standby non-discharge potential is included becomes narrower than the voltage step in which the standby non-discharge potential is not included, it is possible to reduce the power consumption.

According to the configuration, in a case where a waveform of the drive signal is a repeating pattern, the standby non-discharge potential means potentials of a beginning end and a termination end of the waveform and a voltage corresponding to a voltage Vc which will be described below.

In the liquid discharge apparatus according to the aspect, when a voltage waveform of the source drive signal is changed, at least one of the first potential difference or the second potential difference may be changed. In this configuration, when the voltage waveform of the source drive signal which becomes a source of the drive signal that is applied to the piezoelectric element is changed, at least one of the voltage steps is changed in accordance with the voltage waveform of the source drive signal and thereby, it is possible to reduce the power consumption.

The invention can be realized in various aspects such as a control method of the liquid discharge apparatus or a single head unit.

BRIEF DESCRIPTION OF THE DRAWINGS

The invention will be described with reference to the accompanying drawings, wherein like numbers reference like elements.

FIG. 4 is a diagram illustrating an example of a waveform of a source drive signal, a drive signal, or the like.

DESCRIPTION OF EXEMPLARY EMBODIMENTS

Hereinafter, embodiments according to the invention will be described with reference to the drawings.

A printing apparatus according to the embodiment is an ink jet printer, that is, a liquid discharge apparatus, which discharges ink according to image data supplied from an external host computer such that an ink dot group is formed on a printing medium such as paper, and thereby prints an image (including a text, a figure, or the like) in accordance with the image data.

Figure 1:
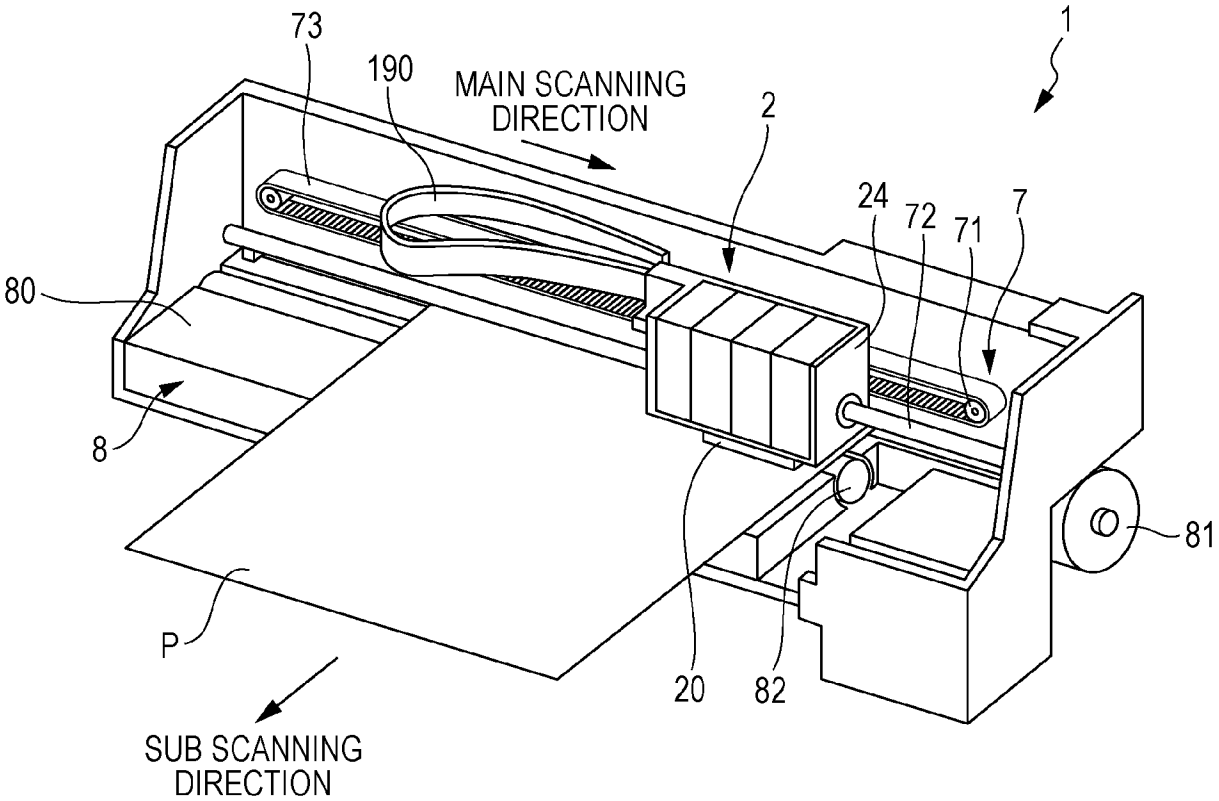
FIG. 1 is a view schematically illustrating a configuration of a printing apparatus.

FIG. 1 is a perspective view schematically illustrating a configuration of a printing apparatus.

As illustrated in FIG. 1, the printing apparatus 1 includes a moving mechanism 7 that causes a moving body 2 to move (reciprocate) in a main scanning direction.

The moving mechanism 7 includes a carriage motor 71 which becomes a drive source of the moving body 2, a carriage guide shaft 72 of which opposite ends are fixed, and a timing belt 73 that extends substantially in parallel with the carriage guide shaft 72 and is driven by the carriage motor 71.

A carriage 24 of the moving body 2 is supported by the carriage guide shaft 72 in a reciprocating manner and is fixed to a part of the timing belt 73. Therefore, when the timing belt 73 is caused to perform forward and reverse travelling by the carriage motor 71, the moving body 2 is guided by the carriage guide shaft 72 and reciprocates.

In addition, a head unit 20 is provided on a portion of the moving body 2 which faces a printing medium P. The head unit 20 discharges ink droplets (liquid droplets) from a plurality of nozzles, as will be described below, and is configured such that various control signals or the like are supplied thereto through a flexible cable 190.

The printing apparatus 1 includes a transport mechanism 8 that transports the printing medium P on a platen 80 in a sub scanning direction. The transport mechanism 8 includes a transport motor 81 which is a drive source and a transport roller 82 which is caused to rotate by the transport motor 81 and transports the printing medium P in the sub scanning direction.

At a time when the printing medium P is transported by the transport mechanism 8, the head unit 20 discharges an ink droplet on the printing medium P and thereby, an image is formed on a surface of the printing medium P.

Figure 2:
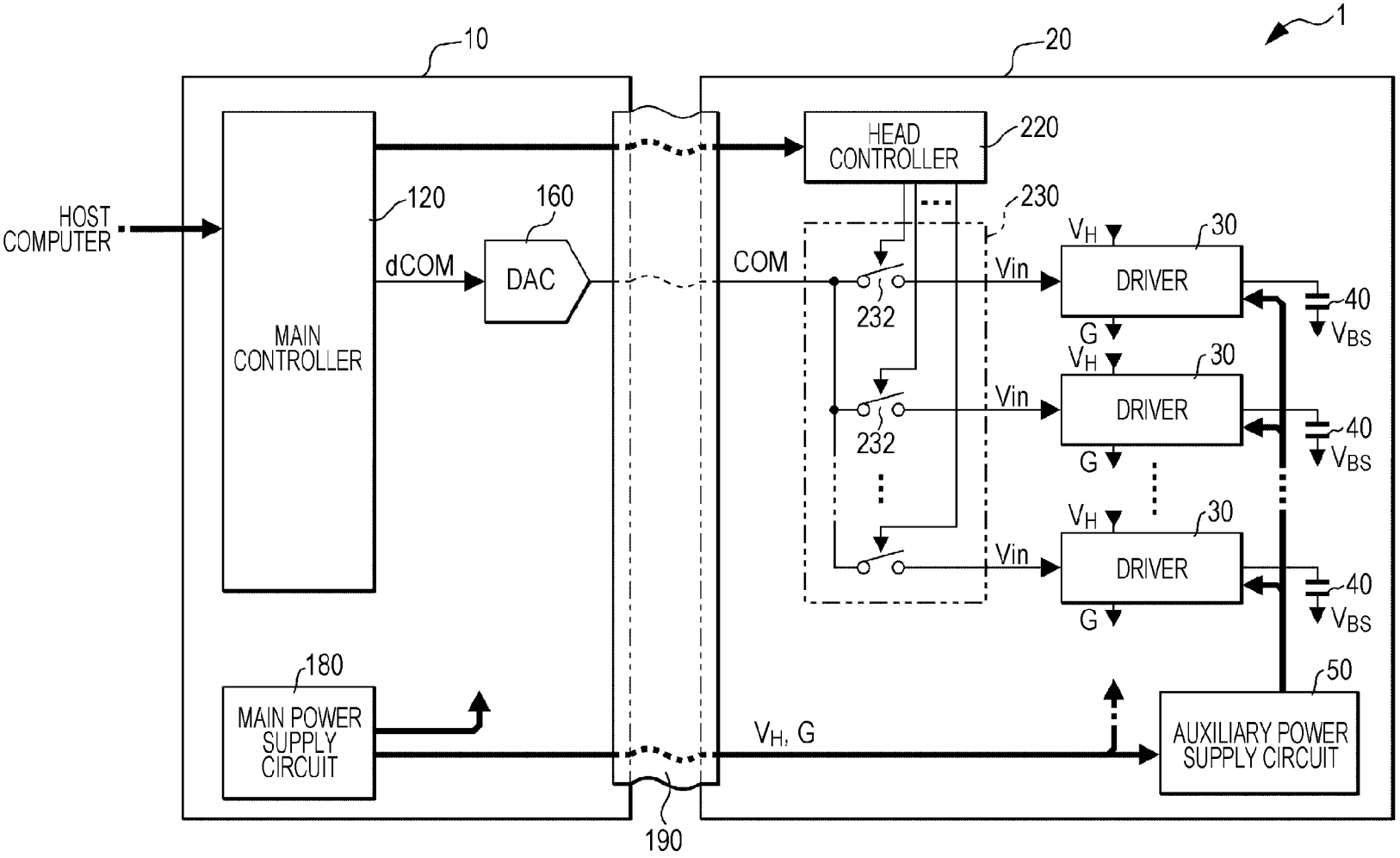
FIG. 2 is a block diagram illustrating a configuration of the printing apparatus.

FIG. 2 is a block diagram illustrating an electrical configuration of the printing apparatus 1.

As illustrated in FIG. 2, the printing apparatus 1 is configured to have a control unit 10 that executes a computing process of printing an image on the basis of the image data supplied from the host computer and the head unit 20 that has a plurality of nozzles. The control unit 10 and the head unit 20 are electrically connected through the flexible cable 190. In addition, the head unit 20 is mounted on a carriage 24 which is movable in a direction (main scanning direction) substantially orthogonal to a feeding direction (sub scanning direction) of the printing medium P.

The control unit 10 includes a main controller 120, a digital to analog converter (DAC) 160, and a main power supply circuit 180.

The main controller 120 executes a computing process of printing such as an image display process, a color conversion process, an ink color separating process, or a half-toning process on the basis of the image data acquired from the host computer and generates a plurality of types of signals which cause the ink to be discharged from a nozzle of the head unit 20. The plurality of types of signals include digital control data dCOM which is supplied to the DAC 160, or various signals which are supplied to a head controller 220 which will be described below.

Details of each computing process of printing which is executed by the main controller 120 may be executed by the host computer in some cases. Since details of the computing process are well known in the technical field of the printing apparatus, a description thereof is omitted.

In addition, as for the printing apparatus 1, a carriage motor that causes a carriage mounted on the head unit 20 to move in the main scanning direction, a transport motor that transports the printing medium in the sub scanning direction, and the like are included, and as for the control unit 10, a configuration of supplying drive signals to these motors are included.

The DAC 160 converts the control data dCOM into a source analog drive signal COM and supplies the converted signal to the head unit 20.

The main power supply circuit 180 supplies a power supply voltage to each component of the control unit 10 or to the head unit 20 and particularly supplies $V_H$ and G as the power supply voltage to the head unit 20.

The voltage G (ground) is a ground potential, and is a voltage of zero, unless specifically described in descriptions below. In addition, the voltage $V_H$ is on a higher side than the ground G according to the embodiment.

One or a plurality of color inks are supplied to the head unit 20 from an ink container through a flow path, though not illustrated specifically. The head unit 20 includes a plurality of sets of drivers 30 and piezoelectric elements (piezo elements) 40, in addition to an auxiliary power supply circuit 50, the head controller 220, and the selection section 230.

The auxiliary power supply circuit 50 generates various voltages by using the power supply voltages $V_H$ and G by the main power supply circuit 180 and feeds the voltages to the plurality of drivers 30 in common. A configuration of the auxiliary power supply circuit 50 will be described in detail.

The head controller 220 controls selection of the selection section 230 in accordance with various signals supplied from the main controller 120.

The selection sections 230 have switches 232 corresponding to the plurality of sets of drivers 30 and piezoelectric elements 40, respectively. While one ends of the switches 232 are connected to one another and are supplied with the source drive signal COM in common, the other ends are connected to input ends of the corresponding drivers 30, respectively. While each switch 232 switches between ON and OFF in accordance with the control by the head controller 220, the source drive signal COM is supplied to the driver 30 during the ON state, and the source drive signal COM is cut off during the OFF state. Therefore, the selection section 230 selects the source drive signal COM supplied from the control unit 10 according to the head controller 220 and supplies the selected signal to the driver 30.

For convenience of description, a source drive signal selected according to the head controller 220 and supplied to the driver 30 among the source drive signals COM is described as Vin.

The driver 30 outputs a drive signal of a voltage Vout in accordance with the source drive signal Vin which is supplied from the selection section 230 by using the various voltages which are supplied from the auxiliary power supply circuit 50 and drives the piezoelectric element 40.

One end of the piezoelectric element 40 is connected to an output end of the corresponding driver 30 and a voltage $V_{BS}$ is applied to the other end of the piezoelectric element 40 in common.

As described above, the piezoelectric element 40 is provided to correspond to each of the plurality of nozzles in the head unit 20 and causes the ink to be discharged by the driving. Next, a configuration of a discharge section which causes the ink to be discharged by driving the piezoelectric element 40 will be described concisely.

Figure 3:
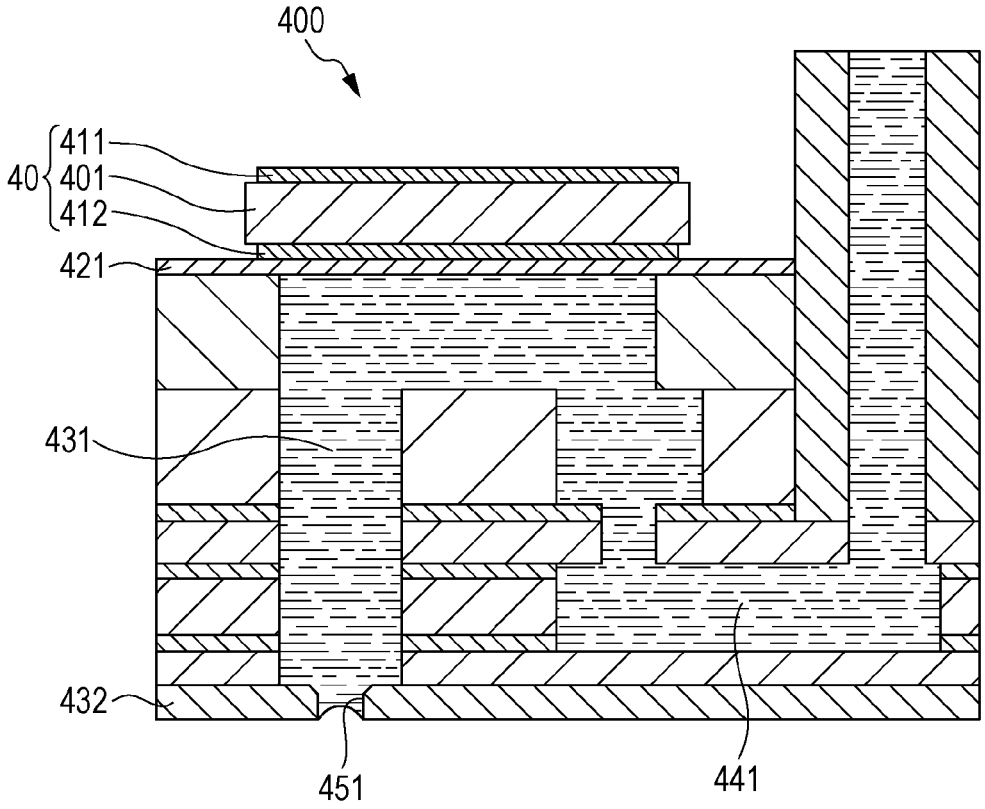
FIG. 3 is a view illustrating a configuration of a discharge section in the head unit.

FIG. 3 is a view schematically illustrating a configuration of a discharge section 400 corresponding to one nozzle in the head unit 20.

As illustrated in FIG. 3, the discharge section 400 includes the piezoelectric element 40, a vibration plate 421, a cavity (pressure chamber) 431, a reservoir 441, and a nozzle 451. The vibration plate 421 is displaced (flexurally vibrated) by the piezoelectric element 40 provided on the top surface in FIG. 3 and functions as a diaphragm that causes an inside volume of the cavity 431 which is filled with the ink to expand/contract. The nozzle 451 is provided in a nozzle plate 432 and is an opening through which communication with the cavity 431 is performed.

The piezoelectric element 40 illustrated in FIG. 3 has a structure in which a piezoelectric body 401 is interposed between a pair of electrodes 411 and 412. The central portion of the piezoelectric body 401 in the structure is bent in the vertical direction with respect to both end portions in FIG. 3 in response to the voltage applied by the electrodes 411 and 412, along with the electrodes 411 and 412 and the vibration plate 421. Specifically, the piezoelectric element 40 is configured to be bent upward, for example, when the voltage Vout of the drive signal is high and to be bent downward when the voltage Vout is low. In the configuration, the upward bending causes the inside volume of the cavity 431 to expand, and thus the ink is caused to be gathered in from the reservoir 441 and the downward bending causes the inside volume of the cavity 431 to contract, and thus the ink is caused to be discharged from the nozzle 451 in response to an extent of the contraction.

The piezoelectric element 40 is not limited to the structure illustrated in FIG. 3, and may be a type in which the piezoelectric element 40 can be caused to deform such that a liquid such as ink can be discharged. In addition, the piezoelectric element 40 is not limited to a configuration in which the flexural vibration is performed, but may have a configuration in which longitudinal vibration is performed.

In addition, the piezoelectric element 40 is provided to correspond to the cavity 431 and the nozzle 451 in the head unit 20 and the piezoelectric element 40 is provided to correspond to the switch 232 in FIG. 2. Therefore, a set of the piezoelectric element 40, the cavity 431, the nozzle 451, the switch 232, and the driver 30 is provided for each nozzle 451.

Figure 4:
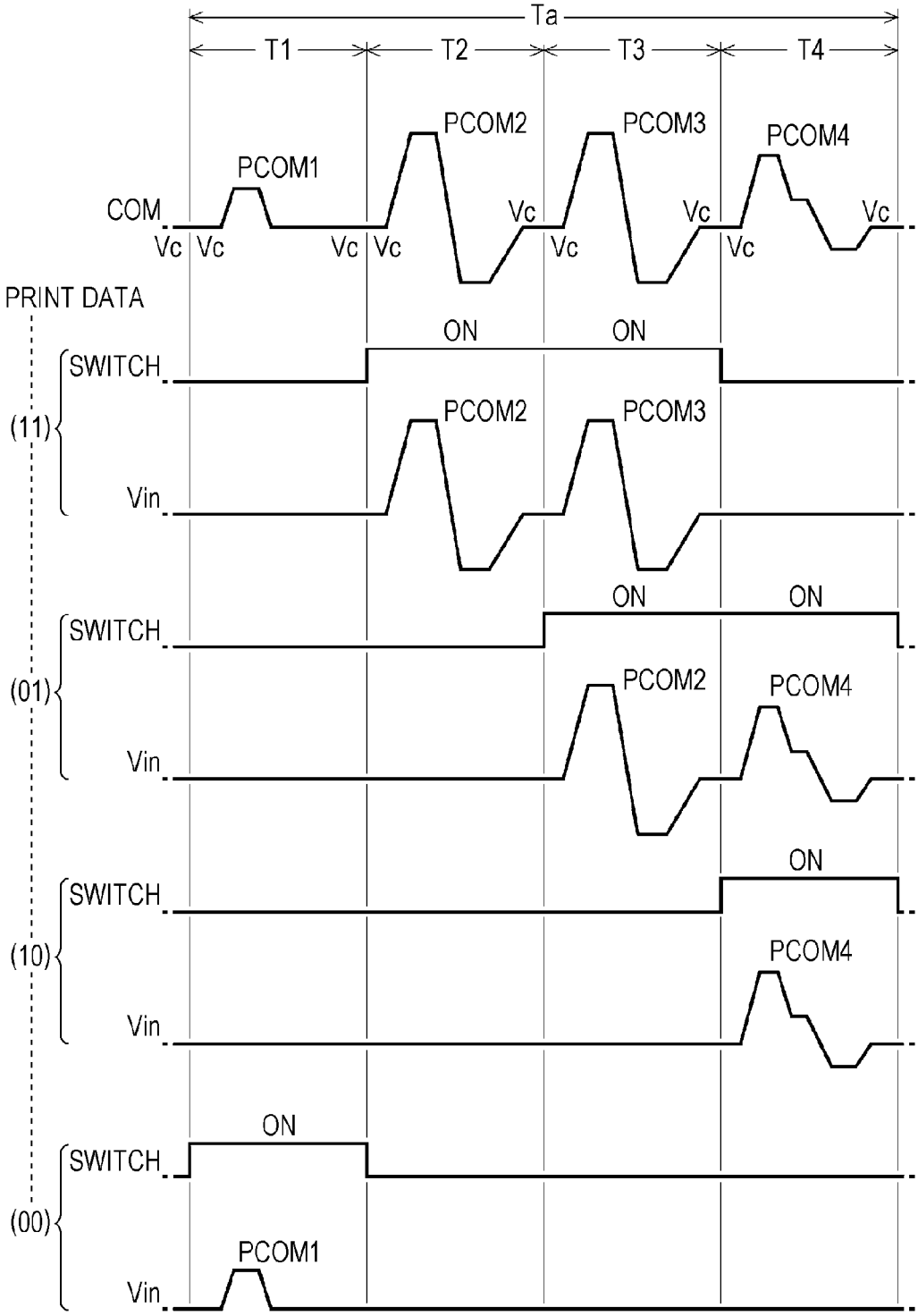

FIG. 4 is a diagram illustrating an example of the source drive signal COM or the like which is supplied to the head unit 20.

As illustrated in FIG. 4, the source drive signal COM has a waveform which is continuous with trapezoidal waveforms (pattern) PCOM1 to PCOM4 that are the minimum units of the signal that drives the piezoelectric element 40 in time series in a printing cycle Ta. The source drive signal COM is actually a waveform which is repeated with a printing cycle Ta as one cycle.

In the printing cycle Ta, the trapezoidal waveform PCOM1 is positioned in a first period T1, the trapezoidal waveform PCOM2 is positioned in a second period T2, the trapezoidal waveform PCOM3 is positioned in a third period T3, and the trapezoidal waveform PCOM4 is positioned in a fourth period T4.

The trapezoidal waveforms PCOM1 to PCOM4 have a voltage Vc at the time of each start and at the time of each end.

The trapezoidal waveforms PCOM2 and PCOM3 according to the present embodiment are substantially the same as each other. When it is assumed that each of the waveforms is supplied to the piezoelectric element 40, the waveforms cause a predetermined amount, for example, a substantially medium amount of ink to be discharged from the nozzle 451.

To be more clear, the central portion of the piezoelectric element 40 is bent upward with respect to both of the end portions in accordance with the increase of the voltage, which causes the inside volume of the cavity 431 to expand, such that the ink is gathered into the cavity 431, whereas the central portion of the piezoelectric element 40 is bent downward with respect to both the end portions in accordance with the drop of the voltage, which causes the inside volume of the cavity 431 to contract, such that the ink is discharged from the nozzle 451.

In addition, the trapezoidal waveform PCOM4 is a waveform different from the trapezoidal waveform PCOM2 (PCOM3). When it is assumed that the trapezoidal waveform PCOM4 is supplied to the piezoelectric element 40, the waveform causes an amount of ink smaller than the above-described predetermined amount to be discharged from the nozzle 451.

The trapezoidal waveform PCOM1 is a waveform that causes the ink in the vicinity of the opening of the nozzle 451 to vibrate minutely and thus the viscosity of the ink is prevented from increasing. Therefore, even though the trapezoidal waveform PCOM1 is supplied to the piezoelectric element 40, no ink droplets are discharged from the nozzle 451.

Meanwhile, 2-bit print data that regulates an amount of ink (tone) to be discharged from the nozzle 451 for each pixel, a pulse that regulates a start timing of the printing cycle Ta, a pulse that regulates start timings of the periods T2, T3, and T4, or the like is supplied to the various signals that are supplied to the main controller 120.

The head controller 220 selects the source drive signal COM in accordance with the various signals supplied from the main controller 120 for each driver 30 as follows and supplies the selected source drive signal COM as the source drive signal Vin.

FIG. 4 illustrates how the source drive signal COM is selected with respect to the 2-bit print data by the head controller 220 and the selection section 230 and is supplied as the source drive signal Vin.

When the print data corresponding to a certain nozzle 451 is, for example, (11), the head controller 220 causes the switch 232 corresponding to the nozzle 451 to be ON in the periods T2 and T3. Therefore, the trapezoidal waveforms PCOM2 and PCOM3 are selected from the source drive signals COM and become the source drive signals Vin. As will be described below, the driver 30 outputs the drive signal of the voltage Vout to follow the voltage of the source drive signal Vin and drives the piezoelectric element corresponding to the nozzle 451. Therefore, a substantially medium amount of ink is discharged twice corresponding to PCOM2 and PCOM3 from the nozzle 451. Accordingly, the inks land and are combined on the printing medium, and as a result, a large dot is formed.

In addition, when the print data corresponding to a certain nozzle 451 is (01), the head controller 220 causes the switch 232 corresponding to the nozzle 451 to be ON in the periods T3 and T4. Therefore, since the trapezoidal waveforms PCOM3 and PCOM4 are selected from the source drive signals COM and drive the piezoelectric element 40, a substantially medium amount and a substantially small amount of ink are discharged twice corresponding to PCOM3 and PCOM4 from the nozzle 451. Accordingly, the inks land and are combined on the printing medium, and as a result, a medium dot is formed.

Meanwhile, when the print data corresponding to a certain nozzle 451 is (10), the head controller 220 causes the switch 232 corresponding to the nozzle 451 to be ON only in the period T4. Therefore, since the trapezoidal waveform PCOM4 is selected from the source drive signals COM and drives the piezoelectric element 40, a substantially small amount of ink is discharged only once from the nozzle 451. Accordingly, a small dot is formed on the printing medium.

When the print data corresponding to a certain nozzle 451 is (00), the head controller 220 causes the switch 232 corresponding to the nozzle 451 to be ON only in the period T1. Therefore, the trapezoidal waveform PCOM1 is selected from the source drive signals COM and drives the piezoelectric element 40, but the ink in the vicinity of the opening of the nozzle 451 in the period T1 is caused to only minutely vibrate. Accordingly, since no ink is discharged, no dot is formed on the printing medium, that is, non-recording occurs.

The source drive signal COM is selected according to such print data and is supplied as the source drive signal Vin (voltage Vout) and thereby four tones of the large dot, the medium dot, the small dot, and the non-recording are expressed.

Such selection operations are executed concurrently for the nozzles 451. Further, waveforms or the like illustrated in FIG. 4 are only examples. Practically, a combination of various waveforms prepared in advance is used according to the movement speed of a carriage, properties of the printing medium, or the like.

Incidentally, when the switch 232 switches to the OFF state, a supply path of the source drive signal Vin from the output of the selection section 230 to the input of the driver 30 enters into a high impedance state. However, practically, the voltage Vc is maintained by parasitic capacitance at the time of start and end of the periods T1 to T4. Therefore, in each of the periods T1 to T4, the source drive signal Vin (voltage Vout) which is supplied to the piezoelectric element 40 becomes either the source drive signal COM (trapezoidal waveforms PCOM1 to PCOM4) or the voltage Vc which is constant.

Therefore, the voltage Vc is a voltage at the time of the start and end of the trapezoidal waveforms PCOM1 to PCOM4 and means a standby voltage in a case where the trapezoidal waveforms PCOM2 to PCOM4 are not selected.

The voltage Vc is changed due to the change of the waveform described above or the like in some cases, but may be considered being fixed in the description of the embodiment.

In addition, an example in which the piezoelectric element 40 is bent upward in response to an increase of the voltage is described, but, when the voltage that is supplied to the electrodes 411 and 412 is inverted, the piezoelectric element 40 is bent downward in response to the increase of the voltage. Therefore, in a configuration in which the piezoelectric element 40 is bent downward in response to the increase of the voltage, the source drive signals COM illustrated in the drawings have waveforms inverted with the voltage Vc as a reference.

Figure 5:
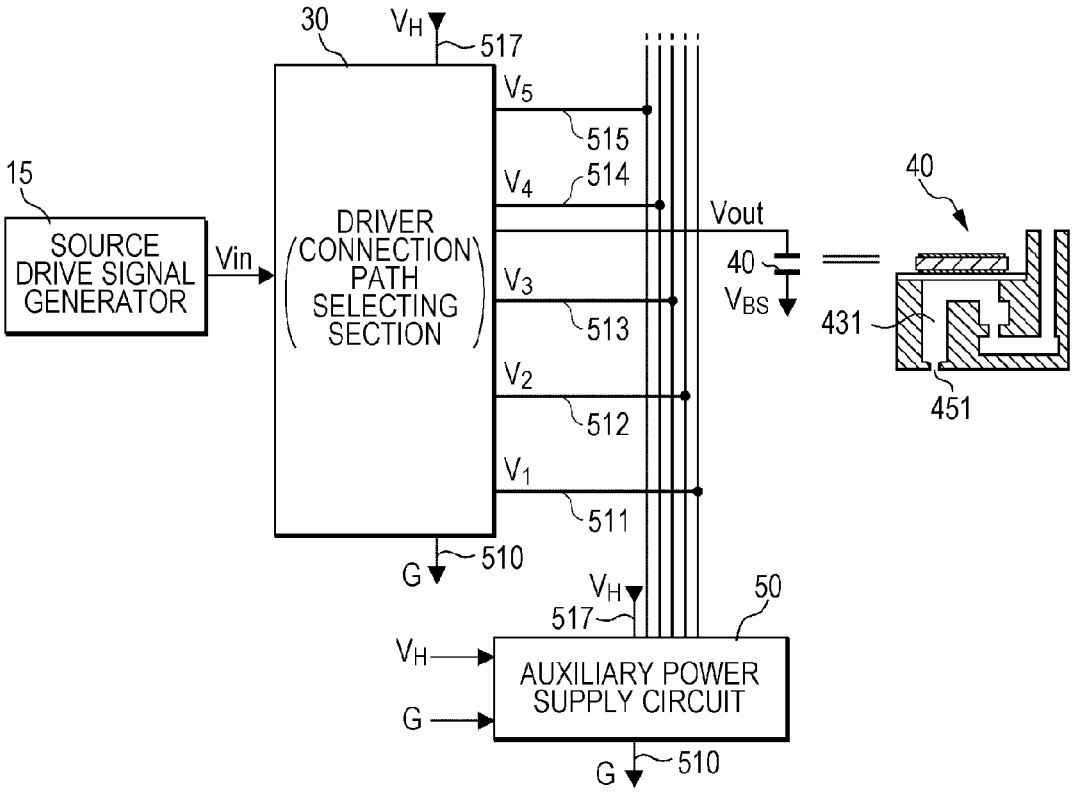
FIG. 5 is a block diagram illustrating a configuration of main components of the printing apparatus.

FIG. 5 is a block diagram illustrating a configuration of main components when focusing on a set of the driver 30 and the piezoelectric element 40 in the printing apparatus 1.

The source drive signal Vin that is supplied to the driver 30 may be a signal which is obtained by extracting the source drive signal COM converted by the DAC 160 by the ON state of the switch 232 corresponding to the driver 30, and by converting the extracted source drive signal COM into the voltage Vc by the OFF state of the switch 232. Therefore, in FIG. 5, the source drive signal Vin is configured to be output from a source drive signal generator 15 which includes the main controller 120, the DAC 160, and the selection section 230, as a single block.

The auxiliary power supply circuit 50 generates and outputs voltages $V_5$, $V_4$, $V_3$, $V_2$, and $V_1$ in descending order from the power supply voltages $V_H$ and G which are supplied from the main power supply circuit 180. According to the present embodiment, the voltages $V_5$ to $V_2$ have relationships with the voltage $V_H$ as follows.

$$V_5=5V_H/7,$$

$$V_4=4V_H/7,$$

$$V_3=3V_H/7,$$

$$V_2=2V_H/7, \text{ and}$$

$$V_11=V_H/7.$$

The voltages $V_1$ to $V_5$ are supplied to the plurality of drivers 30 through the wires 511 to 515 in the order. In addition, the voltages $V_H$ and G are supplied to the plurality of drivers 30 through the wires 517 and 510, respectively. According to the present embodiment, a voltage of $6V_H/7$ is not used in the driver 30.

The piezoelectric element 40 is provided corresponding to each of the plurality of nozzles 451 in the head unit 20 and is driven by the driver 30 as a set to each other. That is, the piezoelectric element 40 is configured to be driven by the drive signal (voltage Vout) which is output from the driver 30.

Figure 6:
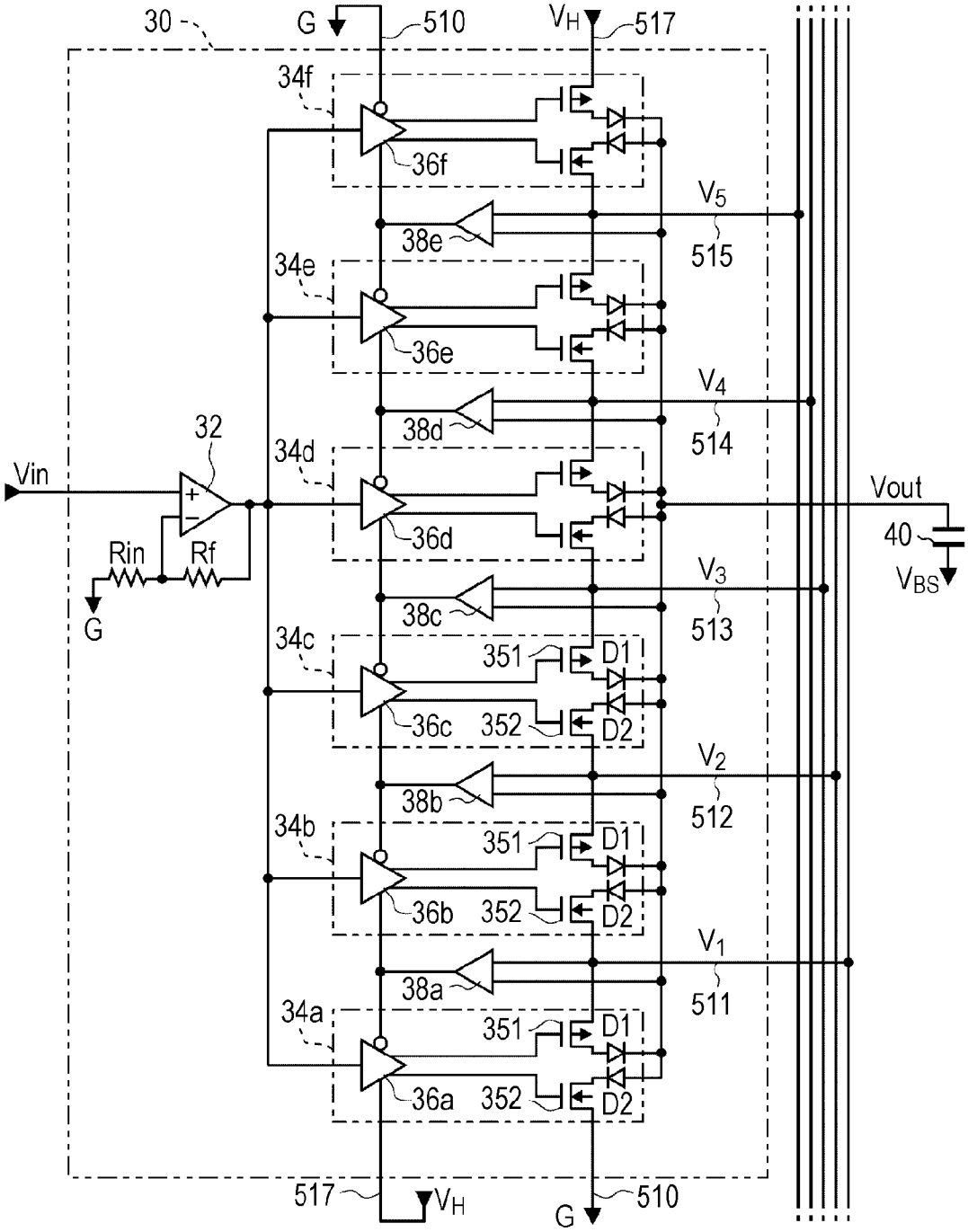
FIG. 6 is a diagram illustrating a configuration of a driver in the head unit.

FIG. 6 is a diagram illustrating an example of a configuration of the driver 30 that drives one piezoelectric element 40.

As illustrated in FIG. 6, the driver 30 includes an operational amplifier 32, unit circuits 34*a* to 34*f*, and comparators 38*a* to 38*e*, and is configured to drive the piezoelectric element 40 in accordance with the source drive signal Vin.

The source drive signal Vin selected by the selection section 230 (switch 232) is supplied to an input end (+) of the operational amplifier 32 which is the input end of the driver 30.

An output signal of the operational amplifier 32 is supplied to each of the unit circuits 34*a* to 34*f*, returns to the input end (−) of the operational amplifier 32 through resistance Rf, and grounded to the voltage G further through resistance Rin. Therefore, the operational amplifier 32 causes the source drive signal Vin to be subjected to (1+Rf/Rin) times non-inverting amplification.

A voltage amplification rate of the operational amplifier 32 can be set by the resistances Rf and Rin, and for the sake of convenience, hereinafter, Rf is set to zero and Rin is set to be infinite. That is, hereinafter, it is described that the voltage amplification rate of the operational amplifier 32 is set to "1" and the source drive signal Vin is supplied as is to the unit circuits 34*a* to 34*f*. It is needless to say that the voltage amplification rate may be other than "1".

The unit circuits 34*a* to 34*f* are provided in ascending order of the voltages corresponding to two adjacent voltages to each other from the seven types of voltages $V_H$, $V_5$ to $V_1$, and G. To be more specific, the unit circuit 34*a* corresponds to the voltage G and the voltage $V_1$, the unit circuit 34*b* corresponds to the voltage $V_1$ and the voltage $V_2$, the unit circuit 34*c* corresponds to the voltage $V_2$ and the voltage $V_3$, the unit circuit 34*d* corresponds to the voltage $V_3$ and the voltage $V_4$, the unit circuit 34*e* corresponds to the voltage $V_4$ and the voltage $V_5$, and the unit circuit 34*f* corresponds to the voltage $V_5$ and the voltage $V_H$.

Circuit configurations of the unit circuits 34*a* to 34*f* are the same as each other, and each includes one corresponding level shifter of the level shifters 36*a* to 36*f*, an N channel type metal-oxide-semiconductor field-effect transistor (MOSFET) 351, and a P channel type MOSFET 352.

Hereinafter, the MOSFET is referred to as the transistor. In addition, when the unit circuits 34*a* to 34*f* are described not specifically but generally, the unit circuits are described only with reference number "34". Similarly, when the level shifters 36*a* to 36*f* are described not specifically but generally, the level shifters are described only with reference number "36".

The level shifter 36 has either an enable status or a disable status. To be more specific, when an L-level signal is supplied to a negative control end to which a circle is attached and an H-level signal is supplied to a positive control end to which no circle is attached, the level shifter 36 enters into the enable status. Otherwise, the level shifter 36 is in the disable status.

As will be described below, the comparators 38*a* to 38*e* are each associated with the intermediate five types of voltages $V_1$ to $V_5$ of the above seven types of voltages, one to one.

Here, when a certain unit circuit 34 is focused on, an output signal of the comparator associated with a higher-side voltage of the two voltages corresponding to the unit circuit 34 is supplied to the negative control end of the level shifter 36 in the unit circuit 34. An output signal of the comparator associated with a lower-side voltage of the two voltages corresponding to the unit circuit is supplied to the positive control end of the level shifter 36.

However, while the negative control end of the level shifter 36*f* in the unit circuit 34*f* is connected to the wire 510 which supplies the voltage G (L level), the positive control end of the level shifter 36*a* in the unit circuit 34*a* is connected to the wire 517 which supplies the voltage $V_H$ (H level).

In addition, in the enable status, the level shifter 36 shifts the voltage of the source drive signal Vin by a predetermined value in a plus direction and supplies the shifted voltage to a gate electrode of the transistor 351, and concurrently, the level shifter 36 shifts the voltage of the source drive signal Vin by a predetermined value in a minus direction and supplies the shifted voltage to a gate electrode of the transistor 352.

In the disable status, regardless of the source drive signal Vin, the level shifter 36 supplies a voltage that causes the transistor 351 to be off, for example, the voltage G, to the gate electrode of the transistor 351, and concurrently, supplies a voltage that causes the transistor 352 to be on, for example, the voltage $V_H$, to gate electrode of the transistor 352.

The predetermined value is set to a voltage (threshold voltage) between the gate-source which is measured when a current starts to flow from a source electrode to a drain electrode. That is, the predetermined value is a property determined according to the characteristics of the transistors 351 and 352.

A higher-side voltage of the corresponding two voltages is supplied to the drain electrode of the transistor 351, and a lower-side voltage is supplied to the drain electrode of the transistor 352.

For example, in the unit circuit 34*a* corresponding to the voltage G and voltage $V_1$, the drain electrode of the transistor 351 is connected to the wire 511 of the voltage $V_1$ and the drain electrode of the transistor 352 is connected to the wire 510 of the voltage G. In addition, in the unit circuit 34*b* corresponding to the voltage $V_1$ and voltage $V_2$, the drain electrode of the transistor 351 is connected to the wire 512 of the voltage $V_2$ and the drain electrode of the transistor 352 is connected to the wire 511 of the voltage $V_1$. In the unit circuit 34*f* corresponding to the voltage $V_5$ and voltage $V_H$, the drain electrode of the transistor 351 is connected to the wire 517 of the voltage $V_H$ and the drain electrode of the transistor 352 is connected to the wire 515 of the voltage $V_5$.

In addition, the source electrodes of the transistors 351 in the unit circuits 34*a* to 34*f* are connected commonly to one end of the piezoelectric element through diodes D1, respectively. In addition, the one end of the piezoelectric element 40 is connected to the source electrodes of the transistors 352 in the unit circuits 34*a* to 34*f* through diodes D2, respectively. That is, a common connection point of a cathode terminal of the diode D1 and an anode terminal of the diode D2 in the unit circuits 34*a* to 34*f* is connected to the one end of the piezoelectric element 40 as an output end of the driver 30.

A voltage of the one end of the piezoelectric element 40, that is, the voltage of the drive signal is referred to as Vout.

The comparators 38*a* to 38*e* correspond to five types of voltages $V_1$ to $V_5$, respectively, compare high and low voltages to each other supplied to two input ends and outputs a signal indicating the compared result. Here, the corresponding voltage is supplied to one end of the two input ends in the comparators 38*a* to 38*e* and the other end is connected to the output end of the driver 30, that is, the one end of the piezoelectric element 40. For example, in the comparator 38*a* corresponding to the voltage $V_1$, the corresponding voltage $V_1$ is supplied to one end of the two input ends and in the comparator 38*b* corresponding to the voltage $V_2$, the corresponding voltage $V_2$ is supplied to one end of the two input ends.

Each of the comparators 38*a* to 38*e* outputs an H-level (voltage $V_H$) signal when the voltage Vout at one end of the input end is equal to or higher than the voltage of the other end, and outputs an L-level (voltage G) signal when the voltage Vout is lower than the voltage of the other end.

Specifically, the comparator 38*a* outputs an H-level signal when the voltage Vout is equal to or higher than the voltage $V_1$, and outputs an L-level signal when the voltage Vout is lower than the voltage $V_1$. In addition, the comparator 38*b* outputs an H-level signal when the voltage Vout is equal to or higher than the voltage $V_2$, and outputs an L-level signal when the voltage Vout is lower than the voltage $V_2$.

When a voltage is focused on of the five types of voltages, the configuration is the same as above in that the output signal from the comparator corresponding to the focused-on voltage is supplied to both of a negative input end of the level shifter 36 of the unit circuit in which the voltage becomes the higher-side voltage and a positive input end of the level shifter 36 of the unit circuit in which the voltage becomes the lower-side voltage.

For example, the output signal from the comparator 38*a* corresponding to the voltage $V_1$ is supplied to both of a negative input end of the level shifter 36*a* of the unit circuit 34*a* with which the voltage $V_1$ is associated as the higher-side voltage and a positive input end of the level shifter 36*b* of the unit circuit 34*b* with which the voltage $V_1$ is associated as the lower-side voltage. In addition, the output signal from the comparator 38*b* corresponding to the voltage $V_2$ is supplied to both of a negative input end of the level shifter 36*b* of the unit circuit 34*b* with which the voltage $V_2$ is associated as the higher-side voltage and a positive input end of the level shifter 36*c* of the unit circuit 34*c* *with which the voltage* $V_2$ is associated as the lower-side voltage.

Next, the operation of the driver 30 will be described.

First, a description of checking the statuses of the level shifters 36*a* to 36*f* with respect to the voltage Vout at the one end of the piezoelectric element 40 is provided.

First, when a status in which the voltage Vout is equal to or higher than the voltage G and less than the voltage $V_1$ is conveniently referred to as a first status, the output signals from the comparators 38*a* to 38*e* all have the L level in the first status. Therefore, in the first status, only the level shifter 36*a* is in the enable status and the other level shifters 36*b* to 36*f* are in the disable status.

When a status in which the voltage Vout is equal to or higher than the voltage $V_1$ and lower than the voltage $V_2$ is referred to as a second status, only the output signal from the comparator 38*b* becomes the H level in the second status and the output signals from the other comparators become the L level. Accordingly, in the second status, only the level shifter 36*b* is in the enable status and the other level shifters 36*a* and 36*c* to 36*f* are in the disable status.

Hereinafter, in a third status in which the voltage Vout is equal to or higher than the voltage $V_2$ and lower than the voltage $V_3$, only the level shifter 36*c* is in the enable status. In a fourth status in which the voltage Vout is equal to or higher than the voltage $V_3$ and lower than the voltage $V_4$, only the level shifter 36*d* is in the enable status. In a fifth status in which the voltage Vout is equal to or higher than the voltage $V_4$ and lower than the voltage $V_5$, only the level shifter 36*e* is in the enable status. In a sixth status in which the voltage Vout is equal to or higher than the voltage $V_5$ and lower than the voltage $V_H$, only the level shifter 36*f* is in the enable status.

When the level shifter 36*a* is in the enable status in the first status, the level shifter 36*a* supplies a voltage signal, on which the level shifting of the source drive signal Vin by a predetermined value is performed in the plus direction, to the gate electrode of the transistor 351 in the unit circuit 34*a*, and supplies a voltage signal, on which the level shifting of the source drive signal Vin by the predetermined value is performed in the minus direction, to the gate electrode of the transistor 352 in the unit circuit 34*a*.

Here, when the voltage of the source drive signal Vin is higher than the voltage Vout, a current in accordance with the difference (from the voltage between the gate-source to the voltage that is higher by the predetermined value) flows from the drain electrode of the transistor 351 to the source electrode thereof in the unit circuit 34*a*. Therefore, when the voltage Vout is gradually increased and approaches the voltage of the source drive signal Vin and eventually the voltage Vout reaches the voltage of the source drive signal Vin, the current flowing to the transistor 351 becomes zero at this time.

Meanwhile, when the voltage of the source drive signal Vin is lower than the voltage Vout, a current in accordance with the difference flows from the source electrode of the transistor 352 to the drain electrode thereof in the unit circuit 34*a*. Therefore, when the voltage Vout is gradually lowered and approaches the voltage of the source drive signal Vin and eventually the voltage Vout reaches the voltage of the source drive signal Vin, the current flowing to the transistor 352 becomes zero at this time.

Accordingly, in the first status, the transistors 351 and 352 of the unit circuit 3*a* execute control of the voltage Vout so as to reach the source drive signal Vin.

Since, in the first status, the level shifter 36 is in the disable status in the unit circuits 34*b* to 34*f* except for the unit circuit 34*a*, the voltage $V_H$ is applied to the gate electrode of the transistor 351 and the voltage G is applied to the gate electrode of the transistor 352. Therefore, since, in the first status, the transistors 351 and 352 are turned off (enter into a non-conductive status) in the unit circuits 34*b* to 34*f*, the transistors 351 and 352 are not involved in the control of the voltage Vout.

Here, the operation in the first status is described, and the operations in the second to sixth statuses are the same. To be more specific, any one of the unit circuits 34*a* to 34*f* is activated according to the voltage Vout held in the piezoelectric element 40, and the activated transistors 351 and 352 of the unit circuit 34 control the voltage Vout so as to reach the source drive signal Vin. Therefore, regarding all of the drivers 30, the voltage Vout is caused to follow the voltage of the source drive signal Vin.

Figure 7A:
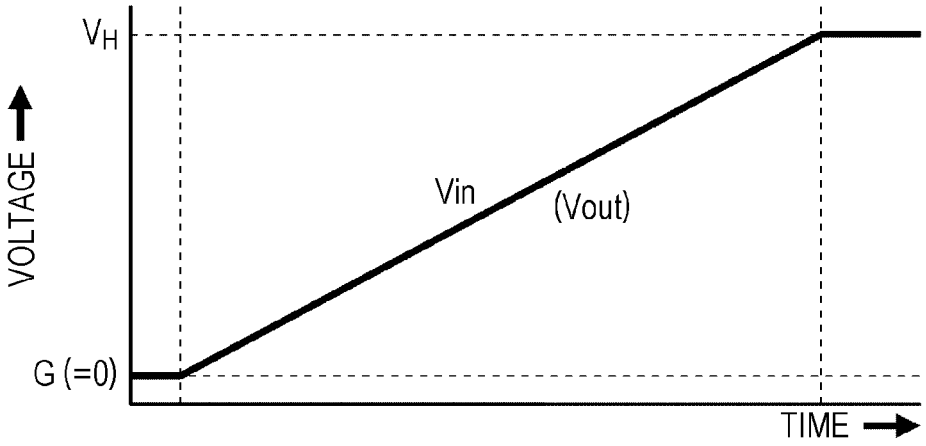
FIGS. 7A and 7B are diagrams illustrating an operational range of each level shifter in the driver.
Figure 7B:
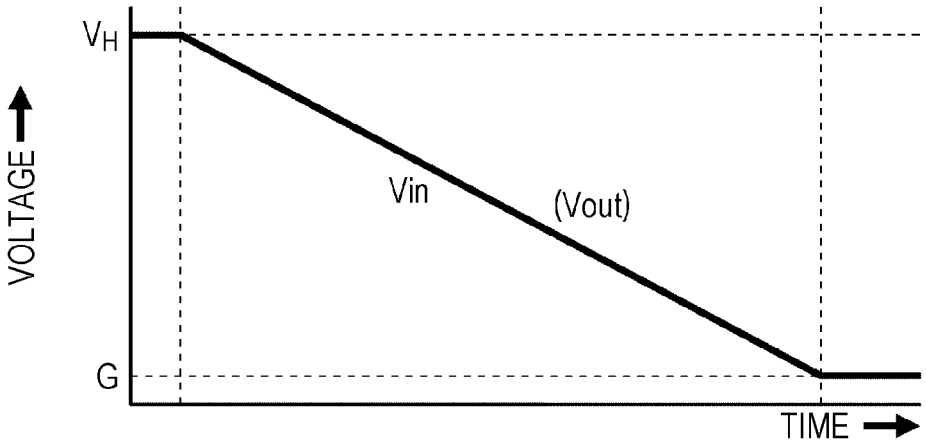

Accordingly, as illustrated in FIG. 7A, when the source drive signal Vin is increased, for example, from the voltage G to the voltage $V_H$, the voltage Vout follows the source drive signal Vin and also changes from the voltage G to voltage $V_H$. In addition, as illustrated in FIG. 7B, when the source drive signal Vin is lowered from the voltage $V_H$ to the voltage G, the voltage Vout follows the source drive signal Vin and also changes from the voltage $V_H$ to the voltage G.

Figure 8A:
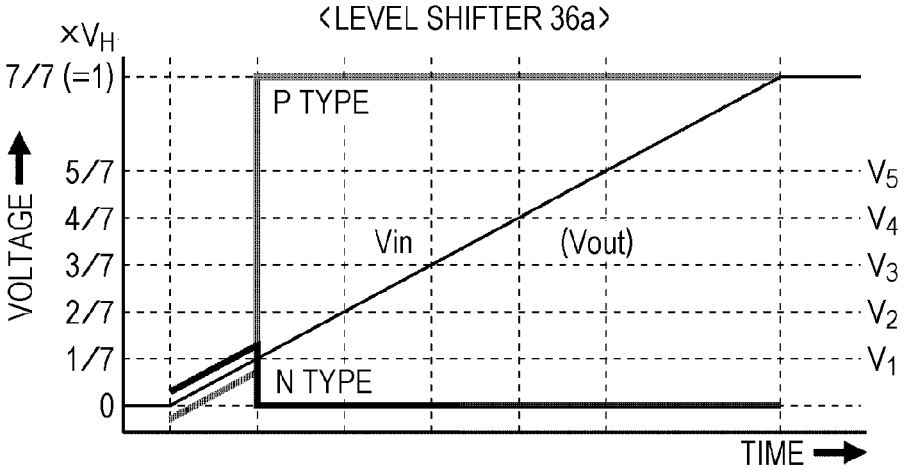
FIGS. 8A to 8C are diagrams illustrating examples of relationships between inputs and outputs in the driver.
Figure 8B:
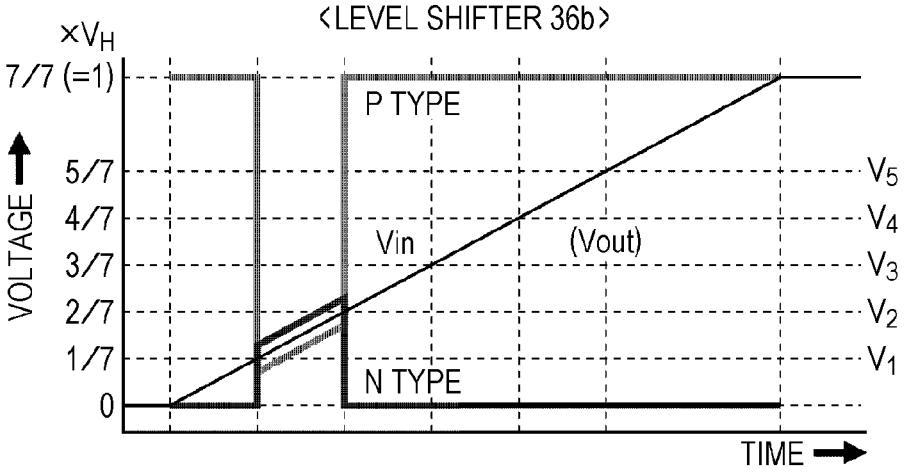
Figure 8C:
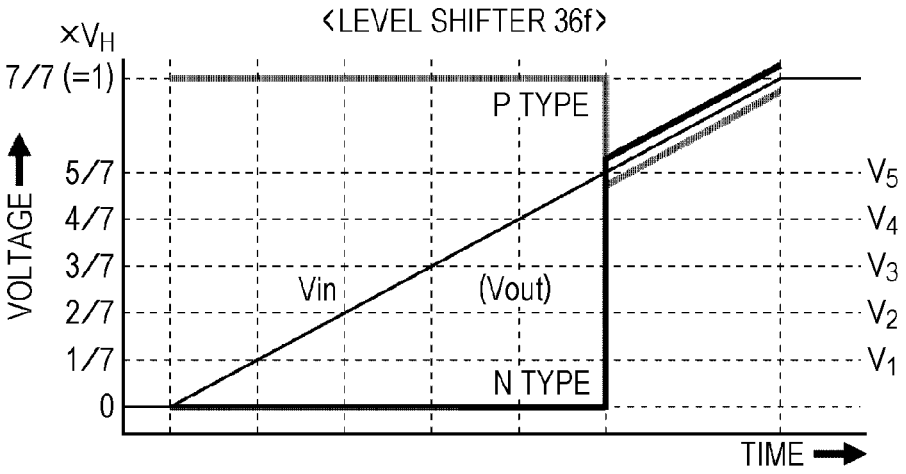

FIGS. 8A to 8C are diagrams verifiably illustrating the operation of the level shifter.

When the source drive signal Vin changes to be increased from the voltage G to voltage $V_H$, the voltage Vout is also increased and follows the source drive signal Vin. In this increasing process, in the first status in which the voltage Vout is lower than the voltage $V_1$, the level shifter 36*a* enters into the enable status. Therefore, as illustrated in FIG. 8A, the voltage (written as "N type") which is supplied to the gate electrode of the transistor 351 by the level shifter 36*a* becomes the voltage on which the shifting of the source drive signal Vin by the predetermined value is performed in the plus direction, and the voltage (written as "P type") which is supplied to the gate electrode of the transistor 352 becomes the voltage on which the shifting of the source drive signal Vin by the predetermined value is performed in the minus direction. Meanwhile, in the statuses other than the first status, since the level shifter 36*a* is in the disable status, the voltage that is supplied to the gate electrode of the transistor 351 becomes G and the voltage that is supplied to the gate electrode of the transistor 352 becomes $V_H$.

FIG. 8B illustrates a voltage waveform output from the level shifter 36*b* and FIG. 8C illustrates a voltage waveform output from the level shifter 36*f*. When it is considered that the level shifter 36*b* enters into the enable status in the second status in which the voltage Vout is equal to or higher than the voltage $V_1$ and lower than the voltage $V_2$, and the level shifter 36*f* enters into the enable status in the sixth status in which the voltage Vout is equal to or higher than the voltage $V_5$ and lower than the voltage $V_H$, a specific description is not necessary.

In addition, a description of the operations of the level shifters 36*c* to 36*e* in the process of increasing the voltage (or voltage Vout) of the source drive signal Vin or a description of the operations of the level shifters 36*a* to 36*f* in the process of lowering the voltage (or voltage Vout) of the source drive signal Vin is omitted.

Next, flow of the current (charge) in the unit circuits 34*a* to 34*f* will be described with examples of the unit circuits 34*a* and 34*b* both during charging and during discharging of the piezoelectric element 40.

Figure 9:
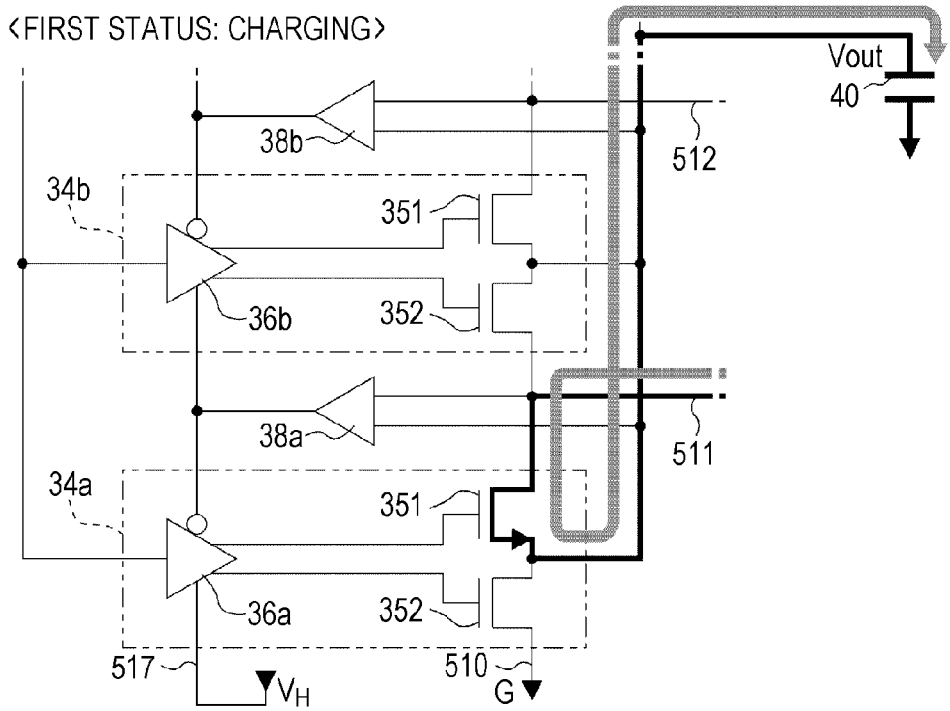
FIG. 9 is a diagram illustrating flow of a current in the driver.

FIG. 9 is a diagram illustrating the operation of the piezoelectric element 40 which is charged in the first status (status in which the voltage Vout is lower than the voltage $V_1$).

Since, in the first status, the level shifter 36*a* enters into the enable status and the other level shifters 36*b* to 36*f* are in the disable status, only the unit circuit 34*a* may be focused on.

When the voltage of the source drive signal Vin is higher than the voltage Vout in the first status, the transistor 351 of the unit circuit 34*a* causes the current to flow in accordance with the voltage between the gate-source. Meanwhile, the transistor 352 of the unit circuit 34*a* is in the OFF state.

During the charging in the first status, the current flows through a path from the wire 511 through the transistor 351 (of the unit circuit 34*a*) to the piezoelectric element 40 as illustrated by an arrow in FIG. 9 such that the piezoelectric element 40 is charged with the charge. The voltage Vout is increased by the charging. Eventually, when the voltage Vout approaches and reaches the voltage of the source drive signal Vin, the transistor 351 of the unit circuit 34*a* enters into the OFF state and thus the charging of the piezoelectric element 40 is stopped.

Meanwhile, in a case where the source drive signal Vin is increased to be equal to or higher than the voltage $V_1$, the voltage Vout follows the source drive signal Vin and also becomes equal to or higher than the voltage $V_1$. Therefore, the status transitions from the first status to the second status (status in which the voltage Vout is equal to or higher than the voltage $V_1$ and lower than the voltage $V_2$).

Figure 10:
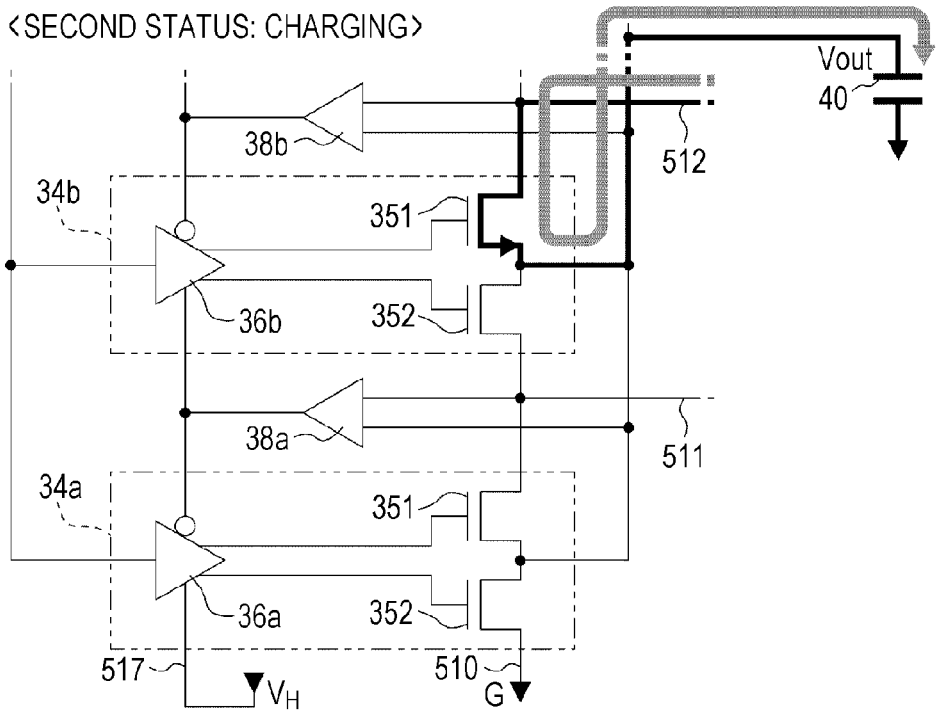
FIG. 10 is a diagram illustrating flow of the current in the driver.

FIG. 10 is a diagram illustrating the operation of the piezoelectric element 40 which is charged in the second status.

In the second status, since the level shifter 36*b* enters into the enable status and the other level shifters 36*a* and 36*c* to 36*f* are in the disable status, only the unit circuit 34*b* may be focused on.

When the voltage of the source drive signal Vin is higher than the voltage Vout in the second status, the transistor 351 of the unit circuit 34*b* causes the current to flow in accordance with the voltage between the gate-source. Meanwhile, the transistor 352 of the unit circuit 34*b* is in the OFF state.

During the charging in the second status, the current flows through a path from the wire 512 through the transistor 351 (of the unit circuit 34*b*) to the piezoelectric element 40 as illustrated by an arrow in Fig. 10 such that the piezoelectric element 40 is charged with the charge. That is, in a case where the piezoelectric element 40 is charged in the second status, one end of the piezoelectric element 40 is electrically connected to the auxiliary power supply circuit 50 through the wire 512.

When the status transitions from the first status to the second status during the increase of the voltage Vout, a current supplying source switches from the wire 511 to the wire 512.

Eventually, when the voltage Vout approaches and reaches the voltage of the source drive signal Vin, the transistor 351 of the unit circuit 34*b* enters into the OFF state and thus the charging of the piezoelectric element 40 is stopped.

Meanwhile, in a case where the source drive signal Vin is increased to be equal to or higher than the voltage $V_2$, the voltage Vout also follows the source drive signal Vin and becomes equal to or higher than the voltage $V_2$. As a result, the status transitions from the second status to the third status (status in which the voltage Vout is equal to or higher than the voltage $V_2$ and lower than the voltage $V_3$).

Since the charging operations from the third status to the sixth status are substantially the same, the current (charge) supplying sources switch to wires 513, 514, 515, and 517 sequentially (not particularly illustrated).

Figure 11:
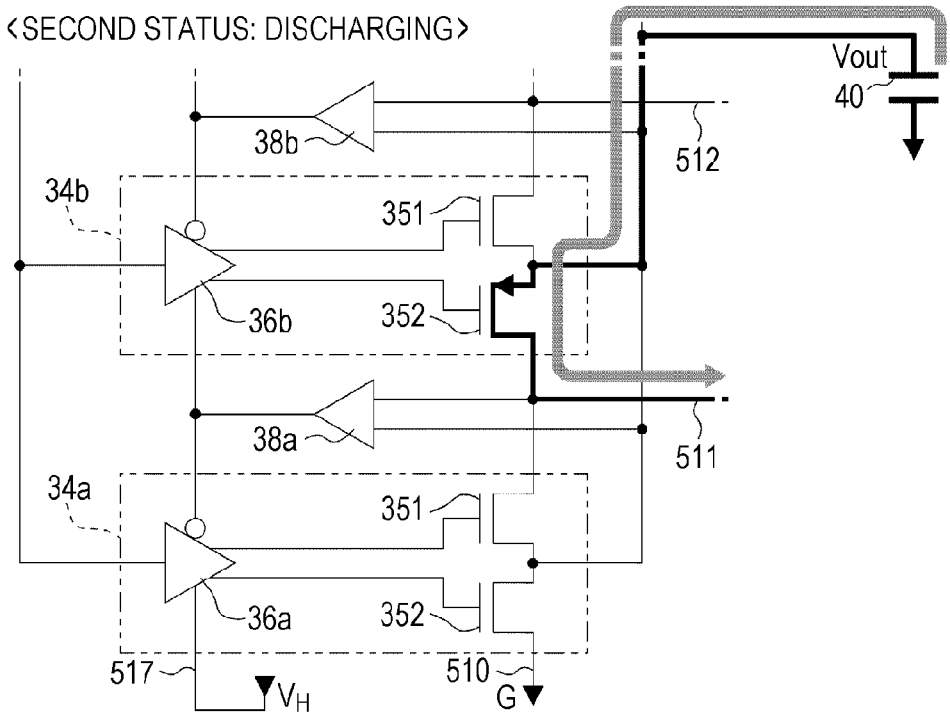
FIG. 11 is a diagram illustrating flow of the current in the driver.

FIG. 11 is a diagram illustrating the operation of the piezoelectric element 40 which is discharged in the second status.

In the second status, the level shifter 36*b* enters into the enable status. When the voltage of the source drive signal Vin is lower than the voltage Vout in this status, the transistor 352 of the unit circuit 34*b* causes the current to flow in accordance with the voltage between the gate-source. Meanwhile, the transistor 351 of the unit circuit 34*b* is in the OFF state.

During the discharging in the second status, the current flows through a path from the piezoelectric element 40 through the transistor 352 (of the unit circuit 34*b*) to the wire 511 as illustrated by an arrow in FIG. 11 such that the charge is discharged from the piezoelectric element 40. In this manner, in a case where the charge is charged in the piezoelectric element 40 in the first status, and in a case where the charge is discharged from the piezoelectric element 40 in the second status, one end of the piezoelectric element 40 is electrically connected to the auxiliary power supply circuit 50 through the wire 511. In addition, the wire 511 supplies the current (charge) during the charging in the first status and collects the current (charge) during the discharging in the second status. The collected charge is redistributed and reused by the auxiliary power supply circuit 50 as will be described below.

Eventually, when the voltage Vout approaches and reaches the voltage of the source drive signal Vin, the transistor 352 of the unit circuit 34*b* enters into the OFF state and thus the discharging of the piezoelectric element 40 is stopped.

Meanwhile, in a case where the source drive signal Vin is lowered to be lower than the voltage $V_1$, the voltage Vout also follows the source drive signal Vin and becomes lower than the voltage $V_1$. As a result, the status transitions from the second status to the first status.

Figure 12:
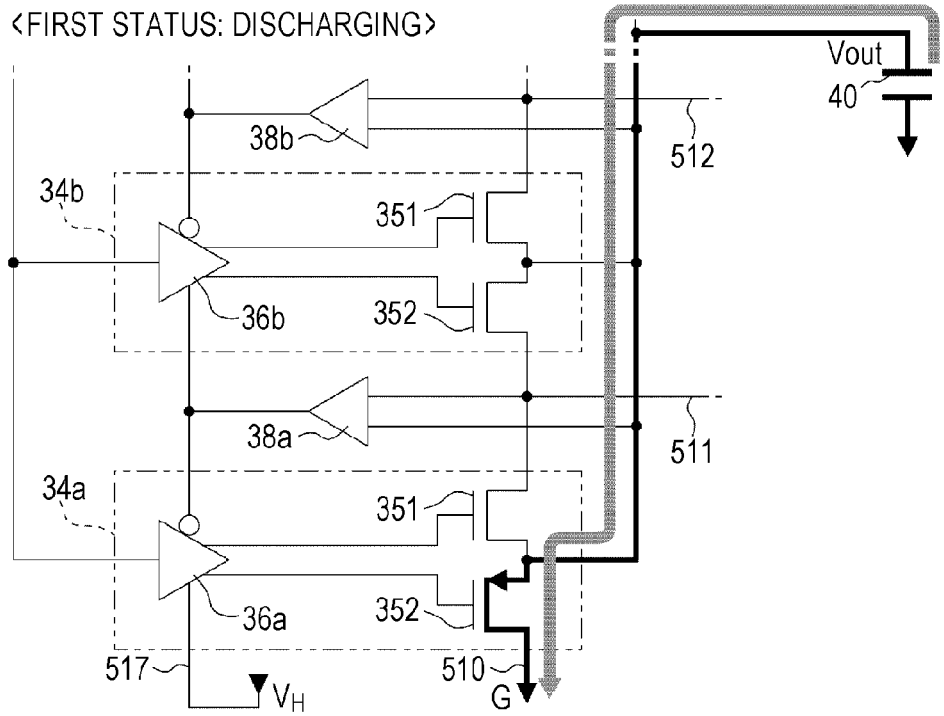
FIG. 12 is a diagram illustrating flow of the current in the driver.

FIG. 12 is a diagram illustrating the operation of the piezoelectric element 40 which is discharged in the first status.

In the first status, the level shifter 36*a* enters into the enable status. When the voltage of the source drive signal Vin is lower than the voltage Vout in this status, the transistor 352 of the unit circuit 34*a* causes the current to flow in accordance with the voltage between the gate-source.

At this time, the transistor 351 of the unit circuit 34*a* is in the OFF state.

During the discharging in the first status, the current flows through a path from the piezoelectric element 40 through the transistor 352 (of the unit circuit 34*a*) to the wire 510 as illustrated by an arrow in FIG. 12 such that the charge is discharged from the piezoelectric element 40.

Here, the unit circuits 34*a* and 34*b* are described as examples both during the charging and during the discharging. The unit circuits 34*c* to 34*f* operate in substantially the same way except that the transistors 351 and 352 which control the current are different.

In this manner, in the present embodiment, the voltage Vout of the drive signal is controlled so as to follow the voltage of the source drive signal Vin.

In FIGS. 9 to 12, the diodes D1 and D2 of the unit circuits 34*a* and 34*b* are omitted and are not illustrated.

Next, the auxiliary power supply circuit 50 will be described.

Figure 13:
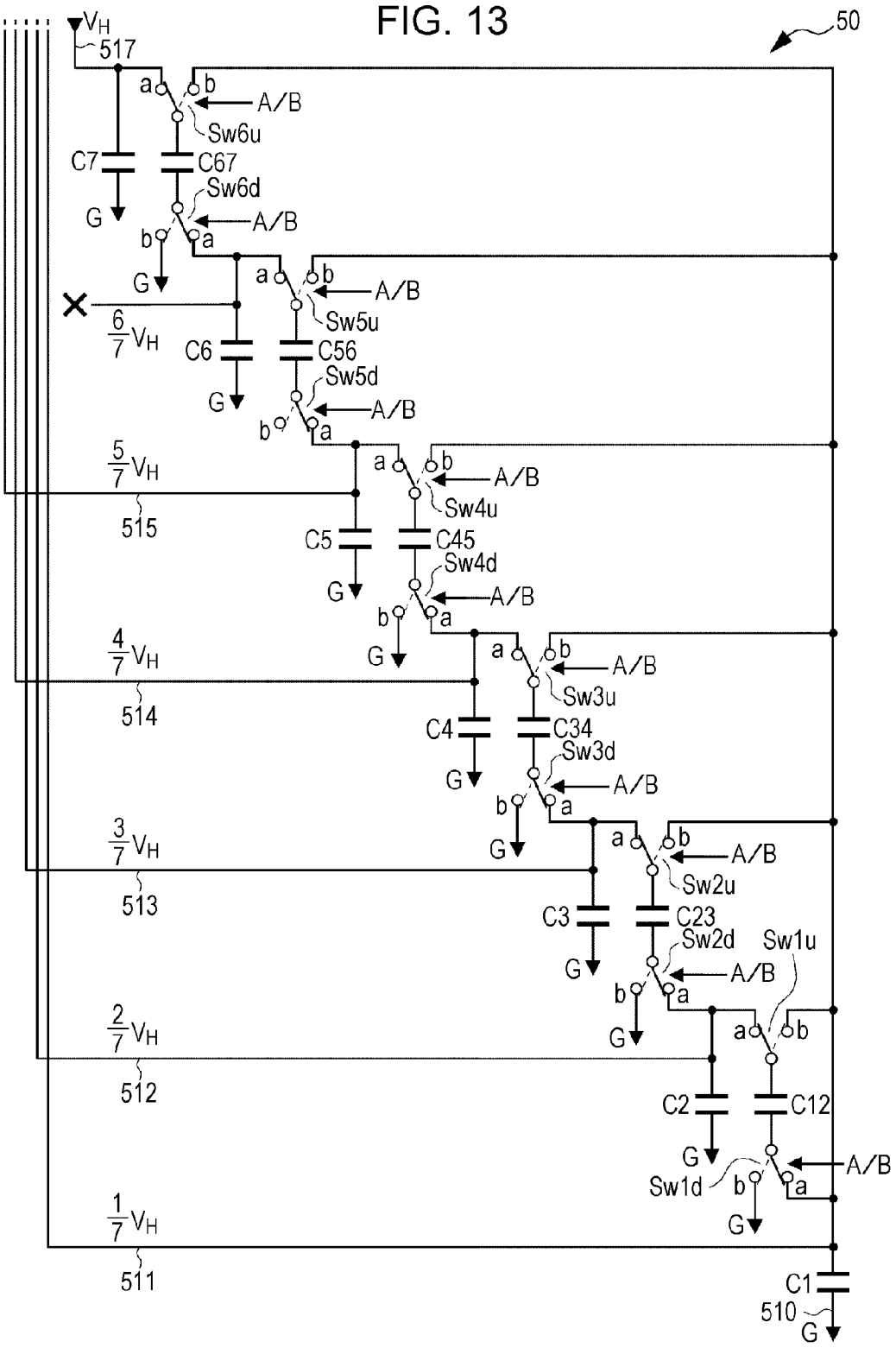
FIG. 13 is a diagram illustrating an example of an auxiliary power supply circuit.

FIG. 13 is a diagram illustrating an example of a configuration of the auxiliary power supply circuit 50.

As illustrated in FIG. 13, the auxiliary power supply circuit 50 is configured to have switches Sw6*u*, Sw6*d*, Sw5*u*, Sw5*d*, Sw4*u*, Sw4*d*, Sw3*u*, Sw3*d*, Sw2*u*, Sw2*d*, Sw1*u*, and Sw1*d*, and capacitive elements C7, C6, C5, C4, C3, C2, C1, C67, C56, C45, C34, C23, and C12.

Among these components, the switches are all one-pole two-throw (single pole double throw) switches and a common terminal is connected to either of terminal a or b in accordance with a control signal A/B. In a brief description, the control signal A/B is, for example, a pulse signal in which a duty ratio is substantially 50% and a frequency thereof is set to be about 20 times the frequency of the source drive signals COM. Such a control signal A/B may be generated by an internal oscillator (not illustrated) in the auxiliary power supply circuit 50 or may be supplied from the control unit 10 through the flexible cable 190.

The capacitive elements C67, C56, C45, C34, C23, C12, and C1 are used for charge transfer. The capacitive elements C7, C6, C5, C4, C3, C2, and C1 are used for backup. The capacitive element C1 serves as the element for both the charge transfer and the backup.

Practically, the above switches are configured by combining the transistors in a semiconductor integrated circuit, and the capacitive elements are mounted on the semiconductor integrated circuit externally. In addition, it is desirable that the semiconductor integrated circuit has a configuration in which the plurality of drivers 30 described above are also formed.

In the auxiliary power supply circuit 50, the wire 517 to which the voltage $V_H$ is applied is connected to one end of the capacitive element C7 and to a terminal a of the switch Sw6*u*. A common terminal of the switch Sw6*u* is connected to one end of the capacitive element C67 and the other end of the capacitive element C67 is connected to a common terminal of the switch Sw6*d*. A terminal a of the switch Sw6*d* is connected to one end of the capacitive element C6 and to a terminal a of the switch Sw5*u*. A common terminal of the switch Sw5*u* is connected to one end of the capacitive element C56 and the other end of the capacitive element C56 is connected to a common terminal of the switch Sw5*d*. A terminal a of the switch Sw5*d* is connected to one end of the capacitive element C5 and to a terminal a of the switch Sw4*u*. A common terminal of the switch Sw4*u* is connected to one end of the capacitive element C45 and the other end of the capacitive element C45 is connected to a common terminal of the switch Sw4*d*. A terminal a of the switch Sw4*d* is connected to one end of the capacitive element C4 and to a terminal a of the switch Sw3*u*. A common terminal of the switch Sw3*u* is connected to one end of the capacitive element C34 and the other end of the capacitive element C34 is connected to a common terminal of the switch Sw3*d*. A terminal a of the switch Sw3*d* is connected to one end of the capacitive element C3 and to a terminal a of the switch Sw2*u*. A common terminal of the switch Sw2*u* is connected to one end of the capacitive element C23 and the other end of the capacitive element C23 is connected to a common terminal of the switch Sw2*d*. A terminal a of the switch Sw2*d* is connected to one end of the capacitive element C2 and to a common terminal a of the switch Sw1*u*. A common terminal of the switch Sw1*u* is connected to one end of the capacitive element C12 and the other end of the capacitive element C12 is connected to a common terminal of the switch Sw1*d*. A terminal a of the switch Sw1*d* is connected to one end of the capacitive element C1 and each terminal b of the switches Sw6*u*, Sw5*u*, Sw4*u*, Sw3*u*, Sw2*u*, and Sw1*u*. The other ends of the capacitive elements C7, C6, C5, C4, C3, C2, and C1 and the terminals b of the switches Sw6*d*, Sw5*d*, Sw4*d*, Sw3*d*, Sw2*d*, and Sw1*d* are commonly grounded to the voltage G.

Figure 14A:
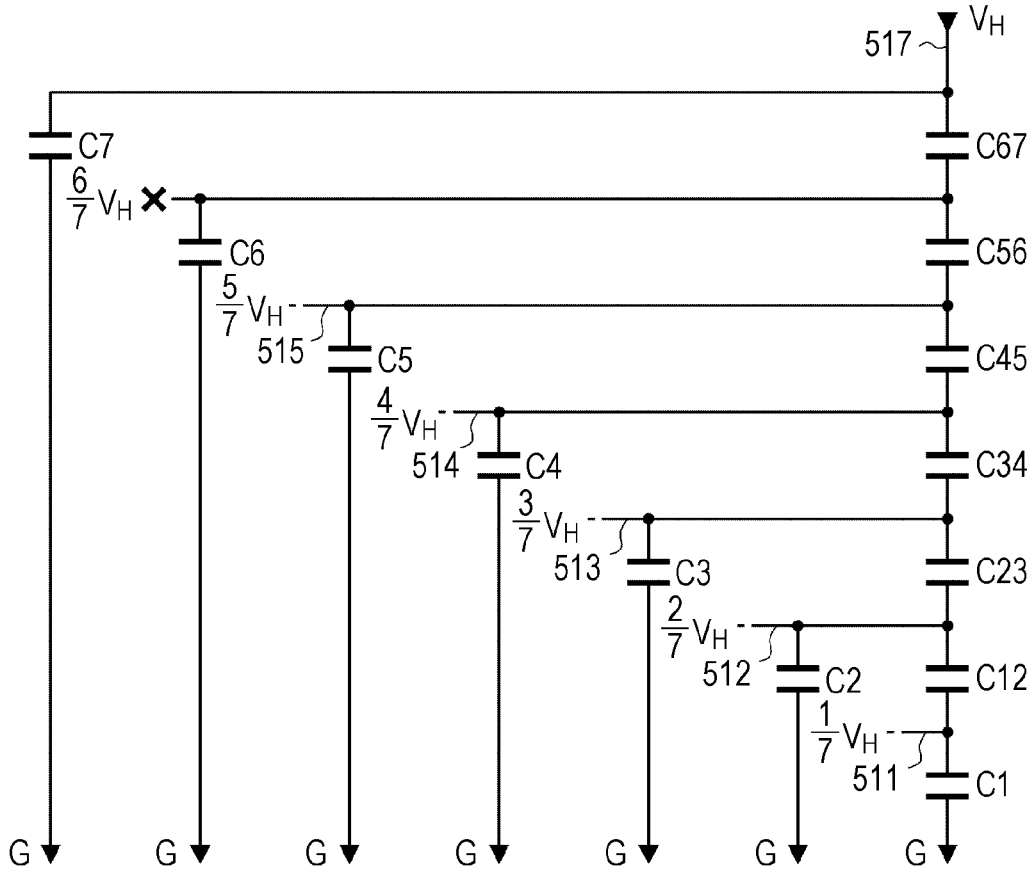
FIGS. 14A and 14B are diagrams illustrating connection of the auxiliary power supply circuit.
Figure 14B:
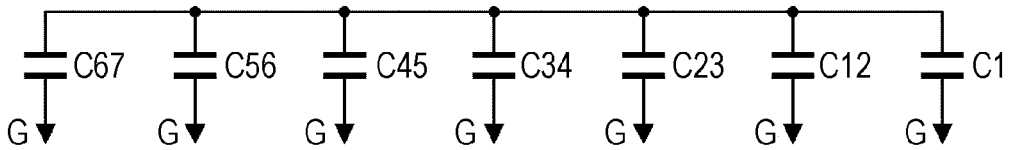

FIGS. 14A and 14B are diagrams illustrating the connection status of the switches in the auxiliary power supply circuit 50.

Each switch has two statuses of a status (status A) in which the common terminal is connected to the terminal a by the control signal A/B and a status (status B) in which the common terminal is connected to the terminal b. FIG. 14A illustrates the connection of the status A in the auxiliary power supply circuit 50 and FIG. 14B illustrates the connection of the status B by using equivalent circuits in a simplified manner, respectively.

In the status A, the capacitive elements C67, C56, C45, C34, C23, C12, and C1 are connected in series between the voltages $V_H$ and G. Therefore, the status A may be called a series status in some cases. When capacitances in the capacitive elements C67, C56, C45, C34, C23, C12, and C1 are the same, a hold voltage of each capacitive element becomes $V_H/7$ in the series status.

Meanwhile, in the status B, one-side ends of the capacitive elements C67, C56, C45, C34, C23, C12, and C1 are commonly connected to one another. Therefore, the status B may be called a parallel status. In the status B, since the capacitive elements C67, C56, C45, C34, C23, C12, and C1 are connected in parallel to one another, the hold voltage is equalized to the hold voltage $V_H/7$.

When the statuses A and B are alternately repeated, the voltage $V_H/7$ equalized in the status B becomes one to seven times as high by the series connection of the status A, and is held in the capacitive elements C1 to C7, respectively.

In the present embodiment, when the hold voltage of the capacitive element C6 is not output to the driver 30, the one-side ends of the capacitive elements C7 and C5 to C1 are connected to the wires 517 and 515 to 511 and the hold voltage is configured to be output to the driver 30 as the voltages $V_H$ and $V_5$ to $V_1$.

When the piezoelectric element 40 is charged by the driver 30, the hold voltage is lowered in the capacitive elements C7, C5, C4, C3, C2, and C1 in the auxiliary power supply circuit 50. However, the capacitive element, in which the hold voltage is lowered, is replenished with a charge from the main power supply circuit 180 (refer to FIG. 2) by the series connection of the status A, and is redistributed and equalized by the parallel connection of the status B.

Meanwhile, when the piezoelectric element 40 is discharged by the driver 30, the hold voltage is increased in the capacitive elements C7, C5, C4, C3, C2, and C1. However, the charge is discharged by the series connection of the status A, and is redistributed and equalized by the parallel connection of the status B.

Accordingly, the charge discharged from the piezoelectric element 40 is collected in the auxiliary power supply circuit 50 and is reused as the charge for charging the piezoelectric element 40.

In general, when the capacitance of the capacitive load such as the piezoelectric element 40 is represented by C and the voltage amplitude is represented by E, energy P accumulated in the capacitive load is represented by $P=(C\cdot E^2)/2$.

The piezoelectric element 40 is deformed by the energy P and works, and an amount of work of discharging ink is equal to or less than 1% of the energy P. Accordingly, the piezoelectric element 40 can be considered a simple capacitor. When the capacitor C is charged with a constant power, the same energy as $(C\cdot E^2)/2$ is consumed by the charging circuit. During discharging, the same energy is also consumed by the discharging circuit.

Figure 15:
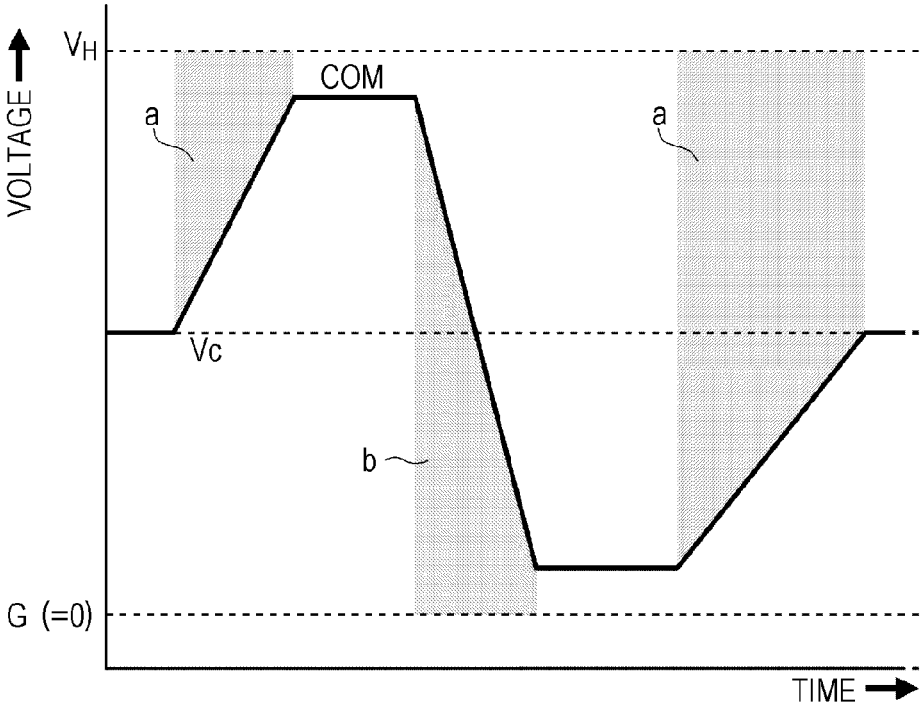
FIG. 15 is a diagram illustrating loss during charging and discharging of the piezoelectric element according to Comparative Example 1.

Here, in a case where the source drive signal Vin changes in a range from the voltage $V_H$ to the voltage G, a configuration may be assumed, in which the piezoelectric element 40 is charged and discharged without dividing the voltage (Comparative Example 1). In the Comparative Example 1, a loss during the charging corresponds to the sum of areas of hatched regions a in FIG. 15 and a loss during the discharging corresponds to an area of a hatched region b in FIG. 15.

In Comparative Example 1, both the loss during the charging and the loss during the discharging are great.

In the present embodiment as described above, the range from the voltage $V_H$ to the voltage G is substantially equally divided into seven regions; however, in the configuration, six voltages except for a voltage $6V_H/7$ are used.

According to the present embodiment, in order to describe a reason that such a configuration is employed, a configuration (Comparative Example 2) is assumed, in which the range from the voltage $V_H$ to the voltage G is substantially equally divided into six regions.

Comparative Example 2 employs a configuration in which the voltages which have relationships of $$V_5=5V_H/6,$$

$$V_4=4V_H/6,$$

$$V_3=3V_H/6,$$

$$V_2=2V_H/6, \text{ and}$$

$$V_1=1V_H/6,$$

as the voltages V5 to V1 in the embodiment are supplied to the plurality of drivers 30 through the wires 511 to 515 in the order.

Figure 16:
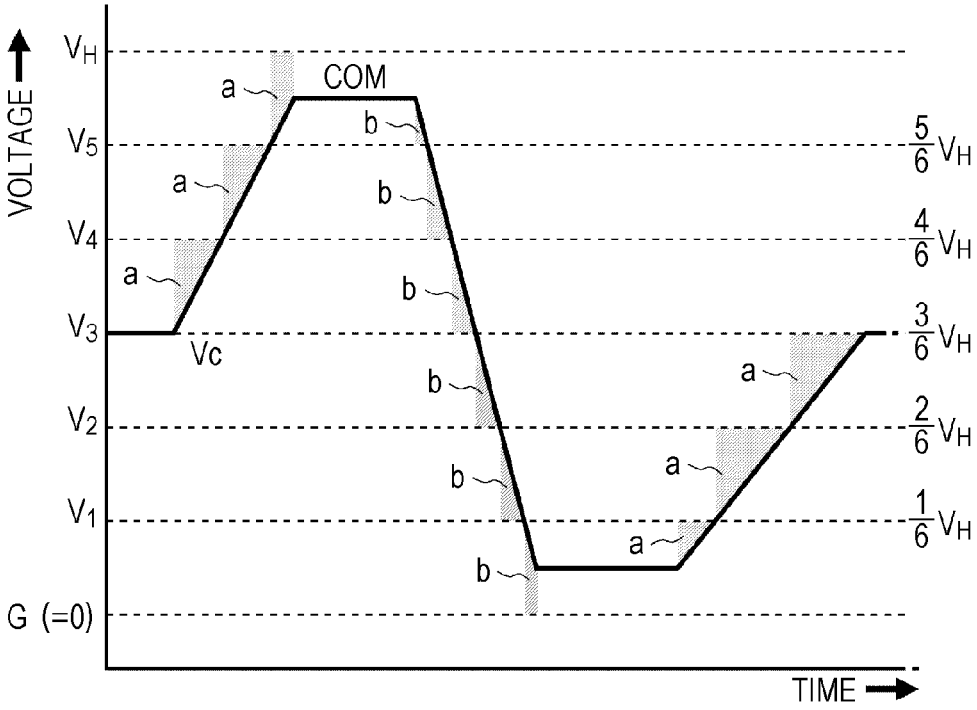
FIG. 16 is a diagram illustrating loss during charging and discharging of the piezoelectric element according to Comparative Example 2.

In Comparative Example 2, the piezoelectric element 40 is charged and discharged in a stepwise manner using the voltage divided from the power supply voltages ($V_H$ and G) into six. Therefore, it is possible to suppress the loss during the charging and the loss during the discharging to be small. To be more specific, since the loss during the charging according to the present embodiment corresponds to the sum of areas of hatched regions a in FIG. 16 and the loss during the discharging corresponds to the sum of areas of hatched regions b in FIG. 16, it is possible to suppress the loss during the charging and the discharging to be small compared to the Comparative Example 1.

In addition, in Comparative Example 2, since the charge discharged from the piezoelectric element 40 is collected by the auxiliary power supply circuit 50 and is reused when the capacitive element is charged, it is possible to greatly suppress the loss as a whole to be small.

Figure 17:
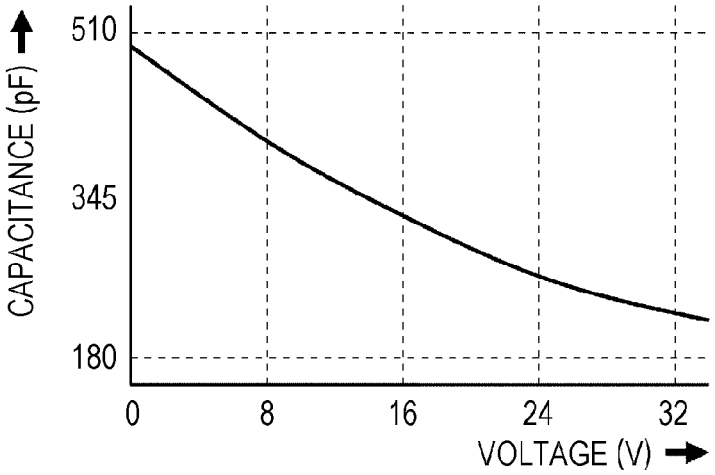
FIG. 17 is a diagram illustrating an example of characteristics of a relationship between voltage and capacitance in the piezoelectric element.

Incidentally, the piezoelectric element 40 is the capacitive load like a capacitor in terms of electric power, but has voltage dependence in which the capacitance thereof is changed due to the applied voltage. To be more specific, for example, as illustrated in FIG. 17, in a region (high-voltage region) in which the applied voltage to the piezoelectric element 40 is high, the capacitance of the piezoelectric element 40 is decreased but in a region (low-voltage region) in which the applied voltage is low, the capacitance is increased to be twice or more. Thus, even when a change rate of the voltage in the piezoelectric element 40 is the same, the current flowing in the piezoelectric element 40 becomes smaller in the region in which the applied voltage is high than in the region in which the applied voltage is low and the power consumption is also reduced.

Accordingly, in Comparative Example 2 in which the power supply voltage is equally divided, power to be consumed when the voltage Vout of the drive signal to the piezoelectric element 40 is changed, for example, by only $V_H/6$ of the voltage step is different between the high-voltage region and the low-voltage region and the power consumption is less in the high-voltage region than in the low-voltage region. In other words, the power consumption is greater in the low-voltage region than in the high-voltage region. Therefore, in Comparative Example 2, the loss in the low-voltage region is so overwhelmingly great that it is assumed that there is room for improvement of the driver 30 that supplies the drive signal to the piezoelectric element 40 using the voltages $V_H$, $V_5$ to $V_1$, and G.

The voltage step indicates a voltage difference of the wires 511 to 515 and 517 of which potentials are adjacent to each other.

In the present embodiment, the power supply voltages ($V_H$ and G) are divided into seven voltages, $6V_H/7$ is not used, and thus, it is possible to reduce the loss in the low-voltage region by employing the configuration in which the voltage step that is an interval between the voltage $V_H$ and the voltage $V_5$ in the high-voltage region is wider than the voltage step in the voltages $V_5$ to $V_1$ and G which become the relatively low-voltage region.

Figure 18:
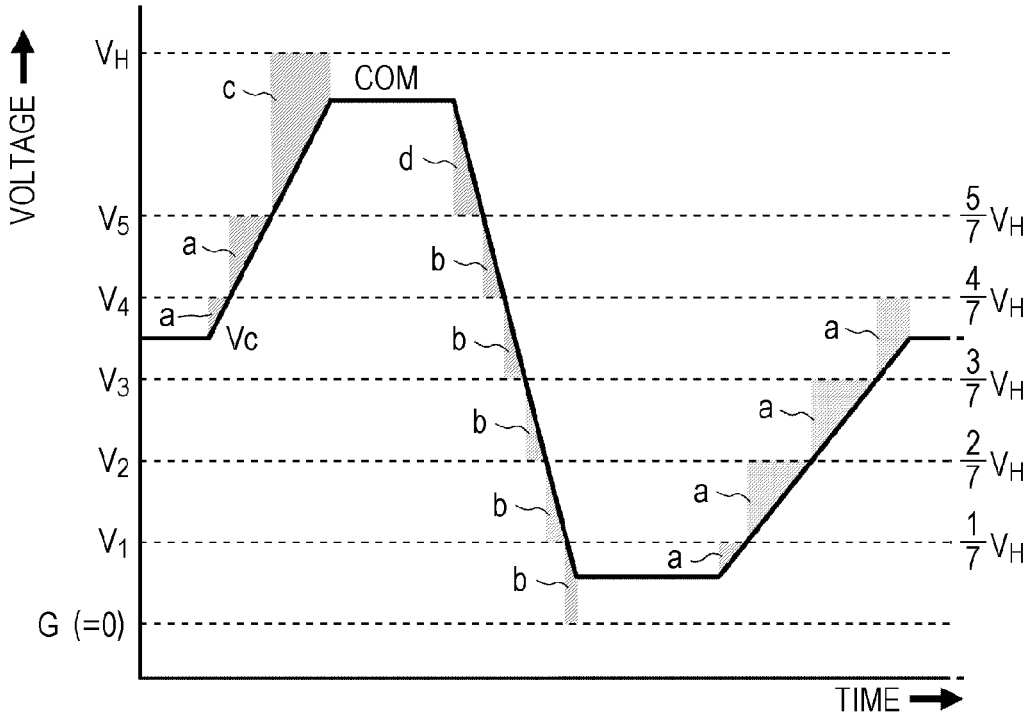
FIG. 18 is a diagram illustrating loss during charging and discharging of the piezoelectric element according to an embodiment.

To be more specific, as illustrated in FIG. 18, since a region c corresponding to the loss in the high-voltage region has a wider width than the voltage step in FIG. 14, the region c is great in terms of an area; however, since the capacitance in the high voltage region becomes small, the power consumption is not great as much as the apparent area. In addition, in FIG. 18, the losses a and b in the low-voltage region has a narrower width of the voltage step than in FIG. 16. Therefore, even when the capacitance is increased in the low-voltage region, the loss is prevented from increasing. Accordingly, in the present embodiment, it is possible to more reduce the power consumption, compared to Comparative Example 2.

Incidentally, when the capacitance of the piezoelectric element 40 is increased in the low-voltage region, for example, a configuration is considered, in which a range from the voltage G to the voltage $V_H/6$ is divided into a plurality of voltages and the loss in the region is reduced in Comparative Example 1. However, in the configuration, the configuration of the auxiliary power supply circuit 50 becomes complicated or the loss in the other regions is increased by widening of the width of the voltage step in the other regions. Therefore, it is not possible to expect the reduction of the power consumption as a whole.

On the contrary, in the present embodiment, the auxiliary power supply circuit 50 that outputs the voltages $5V_H/7$ to $V_H/7$ as the voltages $V_5$ to $V_4$ to the driver 30 includes the voltages $V_H$ and G and, since one of the seven taps is not used in the configuration, it is possible to avoid a complicated configuration and to expect the reduction of the power consumption.

According to the present embodiment, the potential in the voltage $V_4$ is the zeroth potential, the potential in the voltage $V_5$ is the first potential, and the potential in the voltage $V_H$ is the second potential. That is, the embodiment is an example in which the second potential difference from the first potential to the second potential is greater than the first potential difference from the zeroth potential to the first potential.

The embodiment described above is an example in which the capacitance of the piezoelectric element 40 is more increased in the low-voltage region than in the high-voltage region; however, in some cases, the voltage dependence can be ignored by a structure, a vibration mode, or the like of the piezoelectric element 40. Next, it is assumed that the capacitance of the piezoelectric element 40 does not have the voltage dependence.

When the liquid is discharged from the nozzle 451 by a physical displacement of the piezoelectric element 40, the trapezoidal waveform as described above is applied. Here, the meaning thereof is that, in the potential of the drive signal, the voltage is highly frequently changed in the vicinity of the potential in a region in which the maintaining time per a unit time is longer. Therefore, when the width of the voltage step in a region in which the maintaining time is longer in the potential of the drive signal is narrow, the loss due to the voltage change is suppressed. On the contrary, the meaning is that, in the potential of the drive signal, the voltage is less frequently changed or is not changed in the vicinity of the potential in a region in which the maintaining time per a unit time is shorter or zero. Therefore, even when the width of the voltage step in the region in which the maintaining time is shorter in the potential of the drive signal or in the zero region is widened, the loss due to the voltage change is suppressed. The description is provided by using a specific example.

Figure 19A:
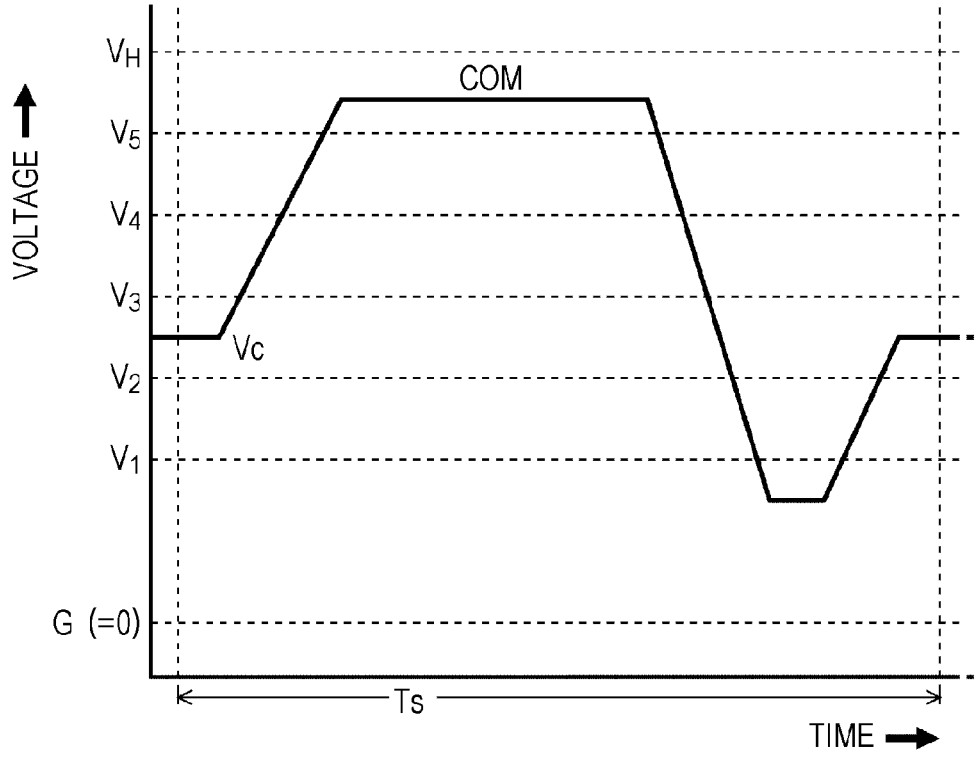
FIGS. 19A and 19B are block diagrams illustrating examples of a voltage step or the like according to Application Example 1.

In a case where the waveform as illustrated in FIG. 19A is assumed as a drive signal, the width of the voltage step in the high-voltage region becomes narrower than the width of the voltage step in the low-voltage region when the maintaining time in the potential of the drive signal in the unit period Is becomes longer in the high-voltage region than that in the low-voltage region. Thus, the loss is suppressed and the reduction of the power consumption is achieved.

Figure 19B:
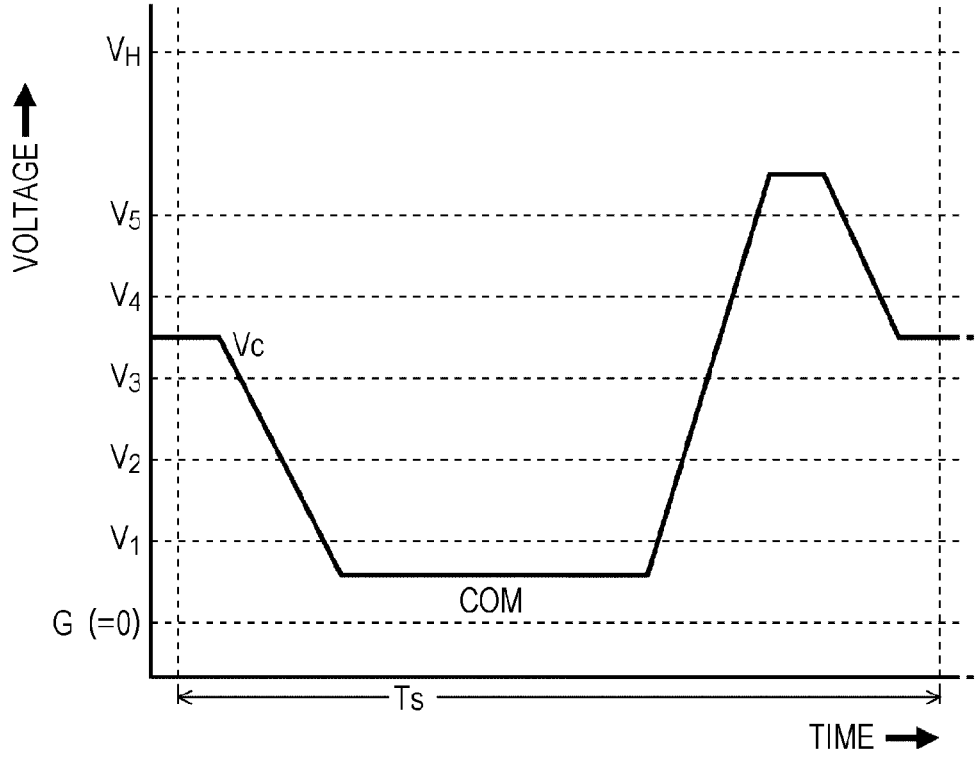

Meanwhile, in a case where the waveform as illustrated in FIG. 19B is assumed as a drive signal, the width of the voltage step in the low-voltage region becomes narrower than the width of the voltage step in the high-voltage region when the maintaining time of the potential of the drive signal in the unit period Ts becomes longer in the low-voltage region than that in the high-voltage region. Thus, the reduction of the power consumption is achieved.

A configuration in which the width of the voltage step is changed may be a configuration in which the width of the voltage step is changed such that the unused voltage is contained in the voltage range in which the width of the voltage step is "widened" in the auxiliary power supply circuit 50.

In addition, the unit period Ts in FIGS. 19A and 19B is a repeated cycle of the trapezoidal waveforms; however, the unit period Is may be the printing cycle Ta in FIG. 4.

In the example in FIGS. 19A and 19B, the potential in the voltage G is the zeroth potential, the potential in the voltage $V_1$ is the first potential, and the potential in the voltage $V_2$ is the second potential. That is, in a case where the maintaining time of the potential of the drive signal becomes longer in the high-voltage region, the example is an example in which the second potential difference is greater than the first potential difference. In a case where the maintaining time becomes longer in the low-voltage region, the example is an example in which the second potential difference is smaller than the first potential difference.

In addition, since the voltage Vc as described above is maintained at the time of the start and the end in the trapezoidal waveform of the drive signal, the trapezoidal waveform is changed with the voltage Vc as an origin point and is changed with the voltage Vc as an end point. Therefore, since the waveform is highly frequently changed in the vicinity of the voltage in the region in which the voltage Vc of the drive signal is contained, the loss due to the voltage change is suppressed when the width of the voltage step is narrowest in the region.

Figure 20A:
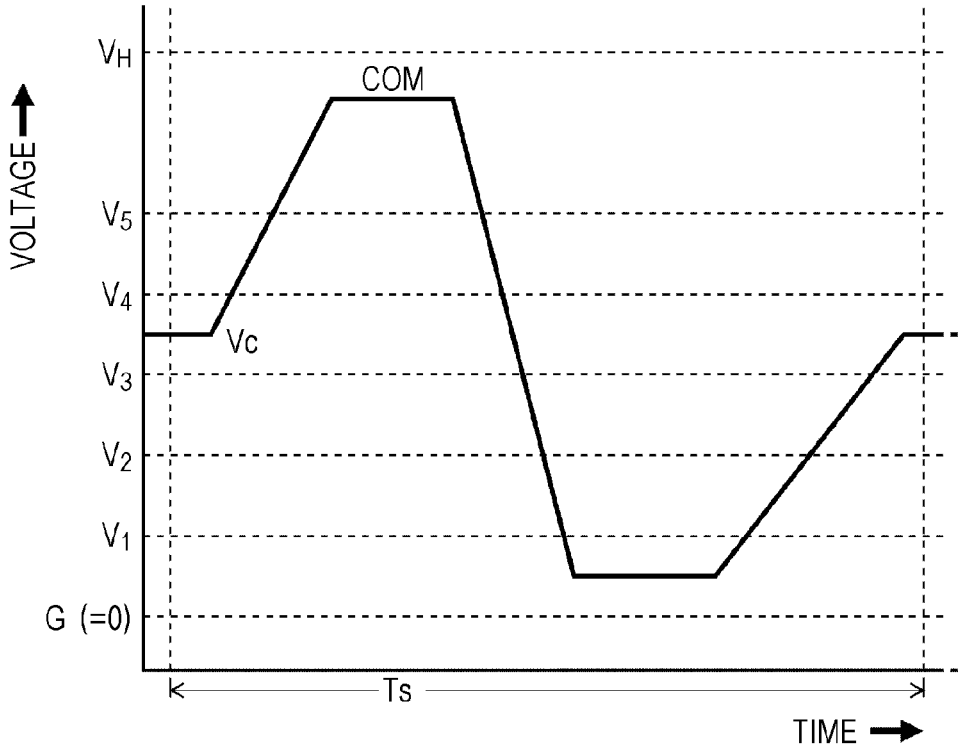
FIGS. 20A and 20B are block diagrams illustrating examples of a voltage step or the like according to Application Example 2.

As in a case where the waveform as illustrated in FIG. 20A is assumed to be the drive signal, the width of the voltage step of the region becomes narrower than the other regions, for example, a region in which the voltage is equal to or higher than the voltage $V_5$ and lower than the voltage $V_H$, preferably, may be narrowest when the voltage Vc at the time of the start and the end of the trapezoidal waveform which is the unit of the drive signal is positioned in a region in which the voltage is equal to or more than $V_3$ and less than the voltage $V_4$.

The example in FIG. 20A is an example in which the potential in the voltage $V_3$ is the p-th potential, the potential in the voltage $V_4$ is the (p+1)-th potential, the potential in the voltage $V_5$ is the q-th potential and, the potential in the voltage $V_H$ is the (q+1)-th potential. That is, in a case where the voltage Vc corresponding to the standby non-discharge potential is equal to or higher than the p-th potential and lower than the (p+1)-th potential, the p-th potential difference from the p-th potential to the (p+1)-th potential is smaller than the q-th potential difference from q-th potential to the (q+1)-th potential.

Figure 20B:
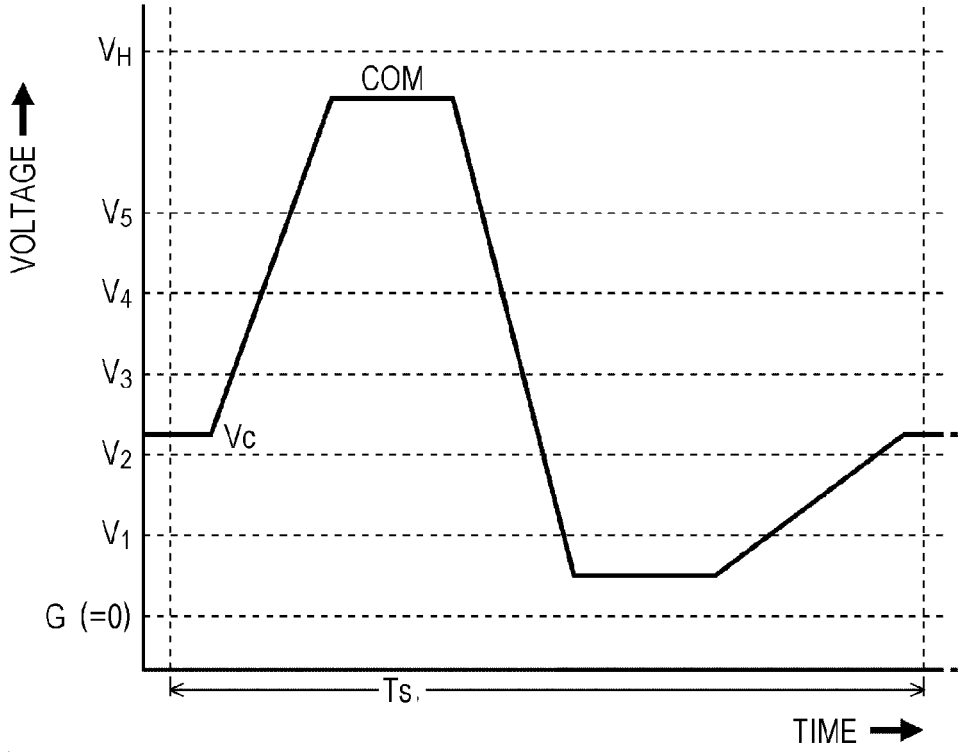

In addition, as in a case where the waveform as illustrated in FIG. 20B is assumed as the drive signal, the width of the voltage step of the region may be narrowest when the voltage Vc at the time of the start and end of the trapezoidal waveform in the unit of the drive signal is positioned in a region in which the voltage is equal to or higher than the voltage $V_2$ and lower than the voltage $V_3$.

When the surrounding temperature of the printing apparatus 1 is changed, viscosity of the ink is changed, the ink is shifted from a target point and lands, and the printing quality deteriorates in some cases. In order to prevent the printing quality from deteriorating, a technology is known, in which the waveform of the drive signal is corrected in accordance with the change of the temperature. Specifically, a vertex coordinate, inclination, amplification, or the like of the trapezoidal waveform of the source drive signal is corrected in accordance with the surrounding temperature detected by a sensor such that the landing position of the ink is not shifted even when the surrounding temperature is changed. When such a trapezoidal waveform is changed, a configuration may be employed, in which the width of the voltage step is changed due to the maintaining time of the potential in the trapezoidal waveform or the position of the voltage Vc.

Figure 21A:
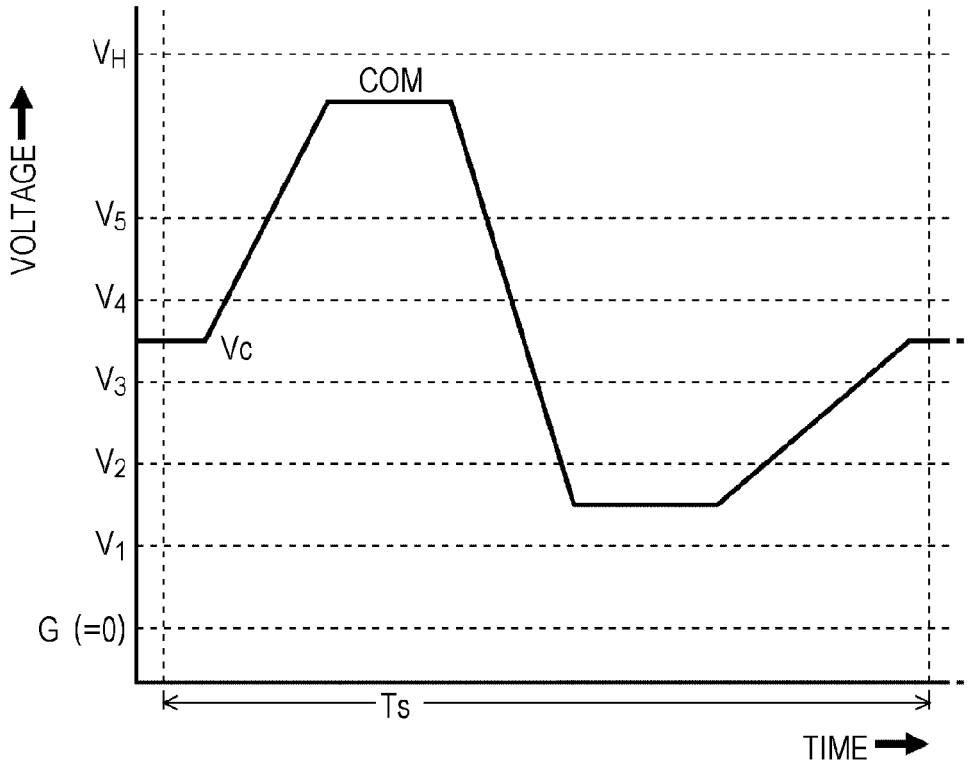
FIGS. 21A and 21B are diagrams illustrating an operation or the like of an auxiliary power supply circuit according to Application Example 3.
Figure 21B:
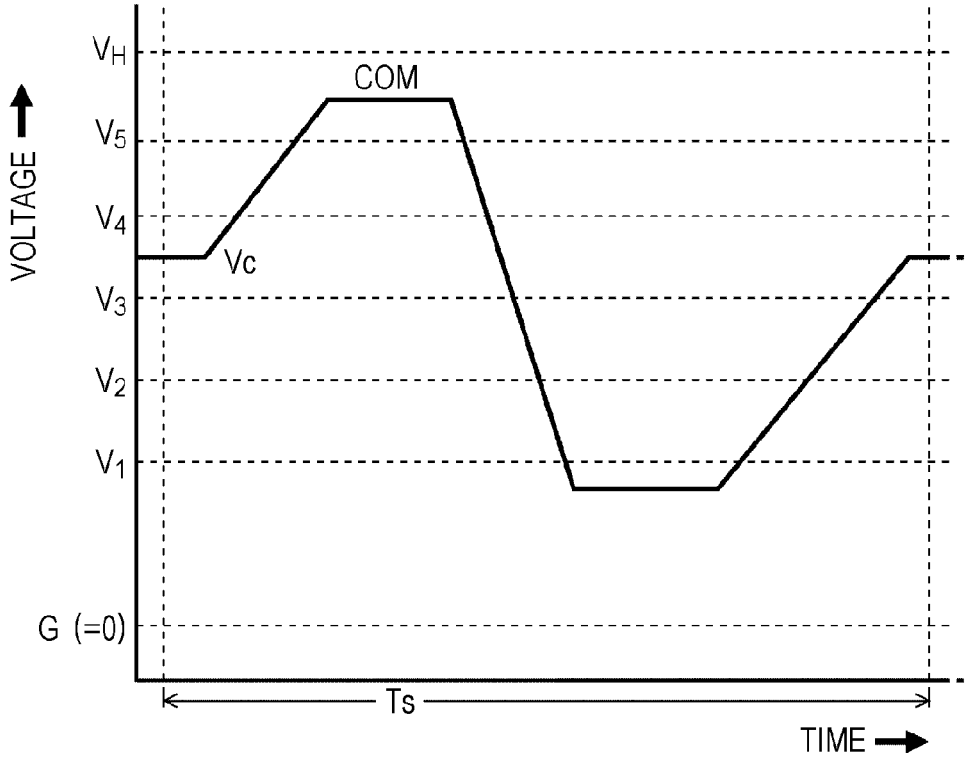

For example, in a certain temperature, in a case where the source drive signal Vin (drive signal COM) becomes a waveform as in FIG. 21A, in a state in which the width of the voltage step in the high-voltage region becomes "widened", the temperature is changed and the source drive signal Vin (drive signal COM) is corrected into a waveform as illustrated in FIG. 21B, that is, when the maintaining time of the potential of the drive signal after the correction becomes shorter in the low-voltage region, the width of the voltage step in the low-voltage region is changed to be "widened".

In this manner, when the waveform of the drive signal is changed, a configuration may be employed, in which a position, where the width of the voltage step becomes "widened" and "narrower" in accordance with the waveform change, is changed.

In the example in FIG. 21, the potential in the voltage $V_4$ is the zeroth potential, the potential in the voltage $V_5$ is the first potential, and the potential in the voltage $V_H$ is the second potential. That is, the example is an example in which the second potential difference is changed due to the temperature change of the first potential difference from the zeroth potential to the first potential and the second potential difference from the first potential to the second potential. The first potential may be changed according to the correction details with respect to the source drive signal and both the first potential difference and the second potential difference may be changed.

The invention is not limited to the above described embodiments but, for example, may be subjected to various modifications as will be described below. One or a plurality of aspects of modification which will be described below may be appropriately combined as selected randomly.

In the driver 30 described above, when the voltages Vout during the increase or drop of the voltage of the source drive signal Vin approach the voltages G, $V_1$, $V_2$, $V_3$, $V_4$, $V_5$ and $V_H$, the current is unlikely to flow in the transistors 351 and 352.

For example, in the driver 30, during the increase of the voltage (or voltage Vout) of the source drive signal Vin, when the voltage of the source drive signal Vin approaches the voltage $V_1$, the current is unlikely to flow in the transistor 351 in the unit circuit 34*a* (because the voltage between the gate-source is low).

During the increase of the voltage of the source drive signal Vin, in a case where the voltage of the source drive signal Vin approaches the voltage $V_1$, not only the transistor 351 in the unit circuit 34*a* but also the transistor 351 in the unit circuit 34*b* which is one stage higher may supply the current to the piezoelectric element 40 through the wire 512.

Similarly, for example, during the drop of the voltage of the source drive signal Vin, when the voltage of the source drive signal Vin approaches the voltage $V_1$, the current is unlikely to flow in the transistor 352 in the unit circuit 34*b*. During the drop of the voltage of the source drive signal Vin, when the voltage of the source drive signal Vin approaches the voltage $V_1$, the current may be supplied to the wire 510 from the piezoelectric element 40 through not only the transistor 352 in the unit circuit 34*b* but also the transistor 352 in the unit circuit 34*a* which is one stage lower.

The embodiment has a configuration in which the six stages of the unit circuits 34*a* to 34*f* are provided in ascending order of the voltages such that the adjacent two voltages correspond to each other of the six types of voltages. However, according to the invention, the number of the unit circuits 34 is not limited thereto. The greater the number of the unit circuits 34, the less the loss during the charging and discharging, but the more complex the configuration.

In addition, the invention is not limited to the liquid discharge apparatus as long as the apparatus performs capacitive load driving, and can be applied to a drive circuit the drives the capacitive load, a pulse sensor that acquires a pulse using the piezoelectric element, or the like.

What is claimed is:

1. A liquid discharge apparatus comprising:

a piezoelectric element in which a drive signal is applied to one end thereof and which is displaced in response to voltages of the one end and the other end thereof;

a cavity which is filled with a liquid and of which an inside volume is expanded and contracted due to the displacement of the piezoelectric element;

a nozzle that communicates with the cavity and is capable of discharging the liquid by the expansion and contraction of the inside volume of the cavity;

a zeroth wire of a zeroth potential;

a first wire of a first potential that is higher than the zeroth potential;

a second wire of a second potential that is higher than the first potential; and a connection path selecting section that electrically connects one end of the piezoelectric element to the zeroth wire, the first wire, or the second wire in response to a voltage of a source drive signal that controls the voltage of the drive signal and a hold voltage of the piezoelectric element, wherein a first potential difference from the zeroth potential to the first potential is different from a second potential difference from the first potential to the second potential.

2. The liquid discharge apparatus according to claim 1, wherein the second potential difference is higher than the first potential difference.

3. The liquid discharge apparatus according to claim 1, wherein the second potential difference is greater than the first potential difference in a case where a time for which the potential of the drive signal is maintained in a first range from the zeroth potential or higher to lower than the first potential is longer than a time for which the potential of the drive signal is maintained in a second range from the first potential or higher to lower than the second potential, and wherein the second potential difference is lower than the first potential difference in a case where the time for which the potential of the drive signal is maintained in the first range is shorter than the time for which the potential of the drive signal is maintained in the second range.

4. The liquid discharge apparatus according to claim 1, further comprising:

a p-th wire of a p-th potential;

a (p+1)-th wire of a (p+1)-th potential which is higher than the p-th potential;

a q-th wire of a q-th potential; and a (q+1)-th wire of a (q+1)-th potential which is higher than the q-th potential, wherein the connection path selecting section electrically connects one end of the piezoelectric element to the p-th wire, the (p+1)-th wire, the q-th wire, or the (q+1)-th wire in response to a voltage of a source drive signal that controls the voltage of the drive signal and a hold voltage of the piezoelectric element, and wherein, when a predetermined standby non-discharge potential is between the n-th potential or higher and lower than the (n+1)-th potential, the p-th potential difference from the p-th potential to the (p+1)-th potential is lower than the q-th potential difference from the q-th potential to the (q+1)-th potential.

5. The liquid discharge apparatus according to claim 1, wherein, when a voltage waveform of the source drive signal is changed, at least one of the first potential difference or the second potential difference is changed.

6. A control method of a liquid discharge apparatus which includes a piezoelectric element in which a drive signal is applied to one end thereof and which is displaced in response to voltages of the one end and the other end thereof, a cavity which is filled with a liquid and of which an inside volume is expanded and contracted due to the displacement of the piezoelectric element, a nozzle that communicates with the cavity and is capable of discharging the liquid by the expansion and contraction of the inside volume of the cavity, a zeroth wire of a zeroth potential, a first wire of a first potential that is higher than the zeroth potential, and a second wire of a second potential that is higher than the first potential, and in which a first potential difference from the zeroth potential to the first potential is different from a second potential difference from the first potential to the second potential, the method comprising:

electrically connecting one end of the piezoelectric element to the zeroth wire, the first wire, or the second wire in response to a voltage of a source drive signal that controls the voltage of the drive signal and a hold voltage of the piezoelectric element.

* * * * *